US007201231B2

(12) United States Patent
Chaplin et al.

(10) Patent No.: US 7,201,231 B2
(45) Date of Patent: Apr. 10, 2007

(54) APPARATUSES AND METHODS FOR DEPLOYING LOGGING TOOLS AND SIGNALLING IN BOREHOLES

(75) Inventors: Michael John Chaplin, Near Nuneaton (GB); Charles Richard Easter, Loughborough (GB); Michael Charles Spencer, Melton Mowbray (GB)

(73) Assignee: Reeves Wireline Technologies Limited, Leicestershire (GB)

( * ) Notice: Subject to any disclaimer, the term of this patent is extended or adjusted under 35 U.S.C. 154(b) by 191 days.

(21) Appl. No.: 10/639,133

(22) Filed: Aug. 12, 2003

(65) Prior Publication Data

US 2004/0069488 A1 Apr. 15, 2004

(30) Foreign Application Priority Data

Aug. 13, 2002 (GB) ..... 0218784.7

(51) Int. Cl.
*E21B 44/00* (2006.01)
*E21B 43/12* (2006.01)
*E21B 28/00* (2006.01)

(52) U.S. Cl. ..... 166/373; 166/53; 166/68; 166/177.2; 166/250.01; 175/40; 73/152.22; 73/152.51; 367/83; 340/853.3; 340/856.4

(58) Field of Classification Search ..... 166/373, 166/381, 383, 386, 53, 250.01, 250.07, 68, 166/177.6, 177.1, 177.2, 319, 332.1, 332.6, 166/332.7, 334.1; 175/24, 40, 48; 73/152.03, 73/152.22, 152.51, 152.53; 367/81, 82, 83; 340/853.3, 855.6, 854.3, 854.4, 856.3, 856.4
See application file for complete search history.

(56) References Cited

U.S. PATENT DOCUMENTS 3,693,428 A * 9/1972 Le Peuvedic et al. ..... 367/85
3,770,006 A * 11/1973 Sexton et al. ..... 137/499
3,800,277 A * 3/1974 Patton et al. ..... 367/83
3,964,556 A * 6/1976 Gearhart et al. ..... 175/45
4,073,341 A * 2/1978 Parker ..... 166/66.4
4,078,620 A * 3/1978 Westlake et al. ..... 175/48
4,120,097 A * 10/1978 Jeter ..... 33/307
4,386,422 A * 5/1983 Mumby et al. ..... 367/85

(Continued)

FOREIGN PATENT DOCUMENTS

EP 0551163 A 7/1993

(Continued)

*Primary Examiner*—Jennifer H Gay
(74) *Attorney, Agent, or Firm*—Paul & Paul

(57) ABSTRACT

The apparatus includes a pump for circulating pressurized fluid in a wellbore. A control device controls the pump which a conduit interconnects to the wellbore. A downhole transducer detects changes in fluid pressure at a downhole location and generates signals accordingly. A processor generates actuator commands based on the signals. Actuators activate a downhole tool based on the actuator command. A modulating valve modulates the fluid pressure. A remote transducer detects the pressure remotely from the downhole transducer. The control device causes the pump to generate acoustic signals in the fluid via wave forms which the downhole transducer detects. The modulating valve generates wave forms in the fluid. The control device sends control signals via the fluid to the downhole transducer. Consequently the processor actuates the tools. Following correct actuation the modulating valve generates signals via pressure changes which the remote transducer receives to indicate successful tool deployment.

62 Claims, 11 Drawing Sheets

U.S. PATENT DOCUMENTS

| | | | | |
|---|---|---|---|---|
| 4,405,021 | A * | 9/1983 | Mumby | 175/48 |
| 4,535,429 | A * | 8/1985 | Russell et al. | 367/85 |
| 4,692,911 | A * | 9/1987 | Scherbatskoy | 367/83 |
| 4,896,722 | A | 1/1990 | Upchurch | |
| 5,113,379 | A * | 5/1992 | Scherbatskoy | 367/83 |
| 5,355,960 | A * | 10/1994 | Schultz et al. | 166/374 |
| 5,375,098 | A * | 12/1994 | Malone et al. | 367/83 |
| 6,016,288 | A * | 1/2000 | Frith | 367/85 |
| 6,105,690 | A | 8/2000 | Biglin, Jr. et al. | |
| 6,310,829 | B1 | 10/2001 | Green et al. | |
| 6,484,817 | B2 * | 11/2002 | Innes | 175/45 |
| 6,714,138 | B1 * | 3/2004 | Turner et al. | 340/854.3 |
| 6,920,085 | B2 * | 7/2005 | Finke et al. | 367/83 |
| 2002/0008634 | A1 * | 1/2002 | Innes | 340/854.3 |
| 2002/0140573 | A1 * | 10/2002 | Carstensen et al. | 340/854.3 |
| 2002/0144842 | A1 * | 10/2002 | Schultz et al. | 175/39 |
| 2003/0000706 | A1 * | 1/2003 | Carstensen | 166/373 |
| 2003/0016164 | A1 * | 1/2003 | Finke et al. | 342/83 |
| 2004/0069530 | A1 * | 4/2004 | Prain et al. | 175/40 |
| 2004/0081019 | A1 * | 4/2004 | Innes | 367/83 |

FOREIGN PATENT DOCUMENTS

| | | |
|---|---|---|
| GB | 2377955 | 1/2003 |
| WO | WO 1994/029572 | 12/1994 |
| WO | WO 1999/054591 | 10/1999 |

* cited by examiner

Pressure Tester Responses

Good Test

APPARATUSES AND METHODS FOR DEPLOYING LOGGING TOOLS AND SIGNALLING IN BOREHOLES

CROSS-REFERENCE TO RELATED APPLICATIONS

This application claims priority under 35 U.S.C. 119 to United Kingdom patent application 0218784.7 filed on Aug. 13, 2002.

BACKGROUND OF THE INVENTION

This invention relates to apparatuses and methods for deploying logging tools and signalling in boreholes.

The logging of boreholes hitherto has used techniques that are well known in the oil and gas industries. The advantages of such an activity are known to those skilled in the art of oil and gas production.

When a borehole is drilled, it is seldom smooth and regular. Sections of the borehole sometimes cave in. Sometimes there are other sections of rock, in particular shales and clays, that squeeze into the borehole as a result of pressure exerted by overlying strata.

Traditionally, borehole logging has involved the use of a so-called wireline logging tool. The wireline logging tool is lowered on a wireline or pushed on drillpipe into the borehole to a downhole, logging location. The wireline logging tool is connected by a wireline to eg. data processing and recording apparatus at a surface location external of the borehole.

Wireline logging tools are of comparatively large diameter. Consequently it is difficult to push or lower a wireline logging tool into a borehole having caved in or squeezed sections as aforesaid.

In recent years it has become known to employ, for the logging of boreholes, a so-called compact logging tool comprising logging tool sections and battery/memory sections. This logging tool typically is of considerably less diameter than a conventional wireline logging tool. It includes a self-contained power supply in the form of a series of batteries; and one or more memory devices, whose function is to record data logged by the logging tool.

Battery/memory logging tools in many circumstances offer advantages over traditional, wireline tools.

It is now known to deploy such a battery/memory logging tool using a so-called "garaging" technique, in which the tool lies retracted within one or more joints of drillpipe during running in of the drillpipe at tripping speed. Once the drillpipe reaches the total depth ("TD") of the well, a mechanism is actuated to cause delatching of a delatchable running sub that during running in of the drillpipe causes retention of the battery/memory logging tool within the drillpipe.

Delatching of the running sub causes deployment of the logging tool to a location protruding from the downhole end of the drillpipe, at which location the logging tool is available for logging operations. Such operations then occur as the drillpipe is withdrawn upwardly from the wellbore. The battery/memory logging tool logs data on the open hole well as it travels upwards towards an uphole location, supported on the end of the drillpipe.

Following withdrawal of all the joints of drillpipe in the wellbore, the memory section of the battery/memory logging tool is recovered. The data recorded therein is downloaded, enhanced and/or analysed as desired.

The known technique for deploying the logging tool includes circulating the well with fluid under pressure, by means of a positive displacement pump connected to the drillpipe at an uphole (surface) location.

This permits the insertion into the drillpipe of a messenger sub. Such a sub is pumpable within the drillpipe to the downhole end thereof, where it operates a release tool. Operation of the release tool causes delatching of the running sub and deployment of the logging tool as aforesaid.

The above-described method has proved highly successful in the data logging art.

Nonetheless there is a need for further improvements in the efficiency of deployment of logging tools.

Rig time is costed at several hundred or thousand dollars per hour. Therefore it is strongly desirable to complete data logging operations in as short a time as possible. However the time taken to pump the messenger sub from an uphole location to approximately the TD of the well can be significant, not least because most oil wells are many hundreds or thousands of meters long.

The drillpipe must be of the correct diameter, and drifted, to ensure that the messenger will pass through the drillpipe and any bottom hole restrictions. Such preparation of the drillpipe is also time-consuming.

The known garaging technique for the deployment of logging tools includes method steps aimed at signalling from a downhole location to an uphole location whether deployment of the logging tool has commenced. There is however a greater need for communication between downhole and uphole locations in oil wells as the logging tools become more complex.

There have been numerous proposals in the past aimed at providing such communication without resorting to wireline connections between the downhole and uphole ends of a drillpipe. In the main such prior art proposals attempt to provide encoded communication between the downhole and uphole locations, by means of acoustic signals generated as pressure pulses in the fluid circulating in the well.

The approach in the prior art has been to develop a language using which it is possible digitally to transmit packets of data within the drillpipe.

This approach suffers from several disadvantages.

Principal among these is the use in the prior art of electromechanical pulsing techniques to generate fluid pressure signals at downhole locations. Typically such techniques involve the use of electrically actuated, mechanical valving members to interrupt the flow of mud (or other fluid) thereby creating pulses of sufficient amplitude to be detectable at a surface location. Since the mass of mud typically requiring to be arrested by the valving members is several thousand kilogrammes the service lives and general reliability of the prior art devices are poor.

A further disadvantage of the prior art techniques is that the speed of data transmission is poor, because of the limited bandwidth of the transmission medium (mud). This problem is acute when attempting to multiplex data transmissions.

SUMMARY OF THE INVENTION

According to a first aspect of the invention there is provided apparatus for remotely activating a tool in a wellbore, the apparatus comprising:

- a positive displacement pump for causing circulation of a fluid under pressure in the wellbore;
- a control device for controlling the speed of operation of the pump;

a conduit that is operatively connected to the pump and extends into the wellbore for conveying the fluid thereinto on operation of the pump;

a downhole transducer, that is capable of detecting changes in the pressure of the fluid and generating one or more detected pressure signals indicative thereof;

a processor that is capable of generating one or more actuator commands in dependence on detected pressure signals generated by the downhole transducer;

one or more actuators that are each operable to activate at least a part of a tool in dependence on a said actuator command;

an activatable tool at a downhole location;

a modulating valve for modulating the pressure of fluid in the conduit; and a remote transducer that is operatively connected to detect pressure of the fluid in the conduit at a location remote from the downhole pressure transducer, wherein operation of the modulating valve is dependent on a downhole event.

Advantageously the apparatus of the invention allows the practising of the garaging method for the rapid deployment of logging tools without the need to pump a messenger sub to a downhole location to initiate releasing of the tool.

The downhole transducer and the processor are capable of initiating a tool deployment operation following the generation of an acoustic signal at a remote location that preferably is a surface location.

The transmission of such an acoustic signal occurs more rapidly than the pumping of the messenger sub to the downhole location. On the other hand, the data requiring transmission to the downhole location in order to initiate tool deployment can be simple. Consequently it can be transmitted in digital or analogue form.

There is no need for multiplexing of data in the acoustic signals, since the presence of the processor at the downhole location means that the acoustic signals need only initiate a further, more complex process that occurs under the control of the processor that is appropriately programmed.

The presence of the modulating valve allows the apparatus to signal from the downhole location to eg. an uphole location that a particular event (such as but not limited to correct deployment of a logging tool) has occurred.

The data necessary for such signalling also are simple, and hence suitable for propagation as analogue or digital acoustic signals in wellbore fluids.

As is explained in more detail below, within the scope of the invention there is no need to attempt the transmission of complex borehole log data by means of acoustic signals.

Conveniently the control device is operable to cause the pump to generate one or more analogue acoustic signals, in the fluid, the waveforms of which are detectable by the downhole transducer.

Preferably the control device is operable to cause the pump to generate one or more digital acoustic signals, in the fluid, the waveforms of which are detectable by the downhole transducer; and the modulating valve is operable to generate one or more analogue or digital acoustic signals, in the fluid, the waveforms of which are detectable by the remote transducer.

Thus the operation of the apparatus according to the invention may if desired be a hybrid of digital and analogue signalling techniques. This confers maximum flexibility on the data transmission, with digital signals being used when there is a need to transmit simple data with a high degree of reliability; and analogue signals being used when it is necessary to transmit from the downhole end of a drillpipe to a remote location an indication of instantaneously prevailing conditions at the downhole end of the wellbore. There may be a short delay of a few seconds, as a result of propagation of the acoustic signal along the drillpipe, before the indication is detectable at the remote location; but this delay is within acceptable limits.

A further advantageous feature of the apparatus of the invention is that it permits timebase modulation of the data generated at the downhole location. This allows matching of the data transmission rate to the bandwidth of the transmission medium (the mud or other fluid).

Preferably the conduit is a drillpipe that is moveable within the wellbore; the activatable tool is moveable relative to the drillpipe; and the drillpipe and the activatable tool include mutually engageable latch parts that, when mutually engaged, retain at least part, or all, of the activatable tool in a retracted position relative to the drillpipe and when disengaged permit movement of the tool to an advanced position in which at least part of the tool protrudes or protrudes further from the downhole end of the drillpipe, the apparatus including a release tool activator that is operable to cause disengagement of the latch parts from one another.

The release tool activator preferably includes or is controlled by a programmable device that is programmed to cause disengagement of the latch parts on the downhole transducer detecting a predetermined sequence of pressure changes in the fluid.

As a consequence the apparatus of the invention is able to detect an encoded, digital signal indicative of a need to deploy a logging tool; and cause releasing of the tool.

The foregoing features of the apparatus of the invention suit it for use in a garaging technique similar to the prior art method outlined hereinabove.

Conveniently the drillpipe when present includes on its interior surface one or more landing stops and the activatable tool includes protruding from an exterior surface one or more landing dogs that are each engageable with a said landing stop on the activatable tool moving to its advanced position relative to the drillpipe.

Even more preferably the landing stop is or includes an annular landing collar extending about the interior surface of the drillpipe.

The foregoing features assist in the deployment of the activatable tool (that in preferred embodiments is a logging tool), since it is desirable for release of the tool from a retracted position to be limited so that the drillpipe and the tool remain in contact with one another. This in turn permits travel of the tool along the wellbore protruding from the drillpipe, during logging operations.

Preferably the operation of the release tool activator to cause disengagement of the latch parts also causes the modulating valve to close whereby movement of the tool to its advanced position causes dethrottling of the flow of fluid at the downhole location, such dethrottling being detectable at the remote location as a period of reduced fluid pressure.

Thus the apparatus of the invention advantageously is capable of signalling to an uphole location the commencement of deployment of an activatable tool or a part thereof.

In preferred embodiments of the invention the apparatus includes a pressure relief valve, whose opening threshold is predetermined; and the engagement of the or each said landing dog with a said landing stop causes the pressure relief valve to generate an analogue, acoustic signal that is indicative of landing of the tool in its advanced position relative to the drillpipe.

The foregoing features assure that the signals generated by the movement of the toolstring and pressure relief valve on initiation of tool release and tool landing are easily detected at a surface or other remote location and are distinctive of the tool deployment action.

The modulating valve optionally is a proportional valve including a valve needle and a valve seat; and acoustic signals generated thereby conveniently are fluid pressure decreases that are proportional to the displacement of the valve needle relative to the seat.

The modulating valve preferably is a proportional valve including a valve needle and a seat therefor; and the acoustic signal is an increase in pressure that is proportional to the displacement of the valve needle relative to the seat.

It is further preferable that the apparatus includes an actuator member that is common to the release tool and the modulating valve whereby operation of the release tool causes movement of the modulating valve.

In a particularly preferred embodiment of the invention the common actuator member is a rod extending centrally within a toolstring, mutually spaced parts of the rod being secured respectively to the release tool, the valve member of the modulating valve and a servomechanism (ie. a speed- and position-controllable device) that moves the rod longitudinally in the toolstring in dependence on one or more said actuator commands.

Connection of the rod to a servomechanism conveniently permits the generation of actuator commands within a processor or other programmable device forming part of the apparatus at a downhole location; and conversion of such commands into an acoustic signal that is detectable at an uphole or other location that is remote from the downhole one.

In other words the apparatus is capable of generating an acoustic signal, that is transmissible to eg. an uphole location, that is distinctive of landing of the activatable tool in its deployed position. Thus the apparatus clearly signals correct deployment of the tool. A surface-located engineer, or software programmed in a microprocessor forming part of or connected to the apparatus, may then know that it is possible to commence logging operations (or other operations carried out by the activatable tool, if the latter is other than a logging tool), without fear that the operations would be a waste of valuable rig time as a result of failed deployment of the tool. In the event of the engineer, or the software, identifying sub-optimal deployment, it is possible under some circumstances promptly to take corrective action such as but not limited to relocating the tool in the borehole.

Preferably the activatable tool includes one or more reaction surfaces against which fluid pressure in the conduit acts.

The presence of such surfaces advantageously permits the pumping, using pressure of fluid in the wellbore, of the activatable tool from its retracted position to its deployed position following releasing thereof.

Preferably the reaction surfaces include one or more flexible, annular sealing members encircling a cylindrical part of the activatable tool so as to seal between the exterior of the tool and the interior of the conduit. The or each reaction surface conveniently is moveable longitudinally of the activatable tool relative to the landing dogs; and the apparatus includes a resiliently deformable member operatively interconnecting the or each reaction surface and a said landing dog.

The resiliently deformable member, that in preferred embodiments of the invention is a coiled spring encircling a cylindrical part of the apparatus of the invention, causes gradual deceleration of the reaction surfaces and the mass of equipment and drilling fluid supported thereby on landing of the tool.

Such controlled deceleration minimises the risk of damage to components of the apparatus on engagement of the landing dogs with the landing stops.

Preferably the logging toolstring includes a cylindrical member that is moveable relative to a chamber, the chamber including one or more ports providing communication between the interior and the exterior of the chamber and the cylindrical member closing the or each said port during deployment of the toolstring, the or each reaction surface being operatively connected to the cylindrical member such that on landing of the tool the cylindrical member moves to open the or each said port to limit the pressure of fluid in the chamber.

It is also preferable that the chamber has formed therein an orifice, the orifice providing fluid communication between the chamber and a further chamber the volume of which changes on movement of the cylindrical member.

Conveniently the coiled spring interconnects the or each reaction member and the cylindrical member.

The foregoing feature permits the forcing of fluid via the orifice into the variable volume chamber. This damps the motion of the reaction surfaces, the components of the apparatus connected thereto and the mass of drilling fluid supported thereby and consequently prevents unwanted oscillations.

It is also preferable that the said chamber includes a wall member having defined therein each said port, the wall member including a perforated sleeve that is releasably secured on the chamber. This feature advantageously permits modification of the port size, by changing of the sleeve to suit the density and viscosity of the fluid in the drillpipe so as to provide for the correct acoustic signal waveform shape.

The apparatus of the invention also conveniently includes a pressure relief valve that opens to vent fluid pressure from within a hollow part of the activatable tool should the pressure within the hollow part exceed a predetermined threshold.

Preferably the apparatus includes a first pressure balancer for balancing fluid pressure on the uphole and downhole sides of the modulating valve.

In practical embodiments of the invention the first pressure balancer is such as to equalise pressures in the chambers on either side of the modulating valve.

The pressure balancer is such that the modulating valve when operating does not have to act against the full pressure, that may be up to several thousand psi, of fluid in the wellbore.

Preferably the apparatus also includes a further pressure balancer that in use lies downhole of the modulating valve and is operatively connected to equalise pressures acting on the uphole and downhole sides of the servomechanism. The purpose of the further pressure balancer is to maintain the loadings on the servomechanism within acceptable values, so that the servomechanism does not have to overcome the borehole pressure during its operation.

In one embodiment of the invention the activatable tool is or includes a formation pressure tester; and the processor is programmed to generate one or more actuator commands for causing operation of the formation pressure tester.

The apparatus of the invention is particularly suitable for use in the deployment of a formation pressure tester.

More specifically, when the apparatus includes the servomechanism as aforesaid the processor is preferably connected and programmed to generate commands for causing one or more of:

(i) operation of the servomechanism to cause unlatching of the mutually engageable latch parts and thereby cause movement of the toolstring that generates an acoustic signal that is indicative of tool release; followed by (ii) operation of the pressure relief valve to signal landing of one or more landing dogs in a landing stop;

(iii) deployment of one or more deployable components of the formation pressure tester;

(iv) powering up and/or self-testing of one or more tools in a toolstring.

When the apparatus of the invention includes the servomechanism as aforesaid, conveniently the activatable tool includes a logging device and a memory device capable of recording data logged by the logging device, the processor being programmed to generate actuator commands for commanding the servomechanism to operate the modulating valve to generate fluid pressure signals in dependence on the recorded, logged data.

Thus the apparatus of the invention is suitable for use with a "wireless" battery/memory logging tool.

In the preferred embodiment of the invention the logged data that is the subject of the signals generated by the programmed device are indicative of the conditions prevailing in the vicinity of the formation pressure tester, rather than entire borehole plots (that preferably are stored in the memory device and subsequently downloaded or otherwise manipulated, following recovery of the formation pressure tester or at least the memory device to a surface location at the end of a logging operation).

Conveniently the apparatus includes a remote transducer that detects pressure of the fluid in the conduit at a location remote from the downhole pressure transducer and generates signals indicative thereof.

More specifically, the remote transducer preferably detects fluid pressure in a standpipe that interconnects the outlet of the pump and the interior of the conduit.

The remote transducer may be, but is not limited to, a pressure gauge, a piezoelectric transducer operatively connected to a display device such as a computer monitor or a pen recorder; a strain gauge; or any of a range of other transducing devices from which a pressure signal may be generated.

In preferred embodiments of the invention at least an output device forming part of or connected to the pressure transducer is located such that a human operator may view it. Consequently the pressure transducer may provide an immediately visible indication of the signals generated by operation of the modulating valve at a downhole location.

Conveniently the apparatus includes an on-board source of electrical power.

Preferably this is in the form of a sub, forming part of a toolstring, that includes a plurality of batteries connected for powering the various components of the apparatus.

According to a second aspect of the invention there is provided apparatus for signalling between a downhole location in a wellbore and a further location that is remote from the downhole location, the apparatus comprising a conduit extending into the wellbore; a pump connected to supply fluid under pressure in the conduit; a modulating valve, at a downhole location, for modulating the pressure of fluid in the conduit; a programmable processor for controlling operation of the modulating valve; a memory device; and a remote transducer for detecting fluid pressure at the further location.

This apparatus contrasts with prior art signalling apparatuses in that it is capable of transmitting analogue data to the further location that preferably is a surface location at which computers, processing apparatus and/or human operators may be located.

Preferably the memory device includes stored therein data logged in the wellbore; and the programmable processor is programmed to cause the modulating valve to modulate the pressure of fluid in the conduit in a fashion that is characteristic of the logged data.

In use of the apparatus the stored data that is transmitted by means of the apparatus of the invention is not, generally, an entire log of a wellbore. On the contrary, the stored data so transmitted preferably relates to instantaneously prevailing conditions in the vicinity of eg. an activatable tool at the time of its activation. Such data are used to confirm successful activation and/or deployment of a tool.

Conveniently the programmable processor is programmed to cause the modulating valve to modulate the pressure of fluid in the conduit in a fashion that is characteristic of two types of data logs (eg. gamma ray and formation pressure logs) carried out at different times.

It is also preferable that the earlier of the two logs is a low frequency Gamma log.

Such features of the apparatus allow for example the use of an accurate Gamma log of a borehole to confirm the position of a formation pressure tester during use, with signals indicative of the position of the formation pressure tester being transmitted via the borehole fluid to an uphole location.

Since the accurate positioning of formation pressure testers (and some other logging tools) is known potentially to consume large amounts of logging time, the foregoing features are highly advantageous.

In preferred embodiments of the invention the formation pressure tester is conventional and of a per se known kind. The formation pressure tester logs and transmits data in a per se conventional manner. A key difference however between the arrangement of the invention and those of prior art devices is that the formation log per se is stored in a downhole memory device. Typically the data transmitted via the medium of the borehole fluid are indicative eg. of whether the formation pressure tester has deployed correctly.

Preferably the modulating valve includes a valve member; a valve seat on which the valve is seatable to raise fluid pressure in the conduit and from which the valve member is removable to reduce fluid pressure in the conduit; a servomechanism connected to operate in dependence on signals generated by the programmable processor; and an actuator member operatively interconnecting the servomechanism and the valve member whereby the valve is openable and closeable in dependence on the signals generated by the programmable processor.

Such an arrangement advantageously is simple and reliable. Operation of this arrangement results in the instantaneous generation of modulating signals in the borehole fluid, on the occurrence of a downhole event.

Conveniently the apparatus includes a logging tool that is capable of logging data characteristic of the wellbore and/or a formation proximate thereto, the logging tool and the memory device being connectable one to the other so that the memory device stores data logged by the logging tool.

The use of such a tool and memory combination conveniently permits the downloading of logged data following completion of logging operations and the recovery of the logging tool to an uphole location, for example as a result of withdrawal of drillpipe from the borehole.

More specifically the logging tool preferably is a formation pressure tester that is deployable against the wellbore in dependence on commands generated by the programmable device.

The programmable device may be programmed to generate signals that cause the modulating valve to generate analogue pressure changes in the fluid in the conduit, the pressure changes mimicking pressure changes experienced by the formation pressure tester in use.

Such signals may be used to signify at an uphole location the correct deployment of a formation pressure tester forming part of the apparatus of the invention.

In a preferred embodiment of the invention the pressure changes generated by the modulating valve include, in the case of a good test carried out by the formation pressure tester:

- an initial pressure increase that mimics sealing of the formation pressure tester pad against the borehole;
- a subsequent pressure decrease caused by operation of the pretest piston of the formation pressure tester that mimics exposure of the formation pressure tester transducer to formation fluid pressure; and
- a subsequent pressure recovery that mimics the building up of formation fluid pressure within the formation pressure tester when the pretest is halted.

Another possibility is for the pressure generated by the modulating valve to include, in the case of the formation pressure tester experiencing a so-called "no seal" condition, a period of substantially invariant fluid pressure that mimics the fluid pressure exerted on the formation pressure tester when carrying out a no-seal test.

Yet a further possibility is for the pressure generated by the modulating valve to include, in the case of the formation pressure tester engaging a so-called "tight formation", a pressure drop (that mimics the fluid pressure experienced by the formation pressure tester when carrying out a pressure test on a tight formation); and a subsequent period without a substantial pressure recovery.

Each of the aforementioned types of pressure modulation generated by the modulating valve is distinctive of a particular instantaneously prevailing downhole condition.

Of the three conditions specified, the "no-seal" and "tight formation" indications would suggest to a human operator that the formation pressure tester is incorrectly located for the acquisition of useful data. It is therefore a highly significant advantage of the apparatus of the invention to be able to signal to a human operator whether the formation pressure tester is incorrectly located. The human operator would then be able as necessary to adjust the position of the formation pressure tester (for example by running in or withdrawing a few inches of drillpipe at a time), with the aim of obtaining from the apparatus of the invention a transmitted indication that a good test has resulted.

The aforementioned formation type data are the kinds of data (that may either be transmitted in real time or stored in the memory device, when present, and subsequently transmitted) that it is envisaged to signal to an uphole location using the apparatus of the invention. The actual formation logs (that typically are highly complex and require detailed analysis and/or manipulation) would be fed from the formation pressure tester to the memory device and stored in the latter. On retrieval of the formation pressure tester and memory device to an uphole location the formation log data could be downloaded in a per se known manner.

Conveniently the apparatus of the invention includes a source of electrical power operatively connected to power as necessary the programmable device, the modulating valve and the logging tool. Consequently the apparatus is of the wireless type, that is associated with significant advantages.

Preferably the programmable device, the modulating valve, the logging tool and the source of electrical power are secured one to another in a discrete toolstring.

Thus the toolstring may be assembled at a surface location and deployed according to a modified version of the so-called garaging technique. The apparatus of the invention may then signal to the uphole location whether the tool is correctly deployed and operating (and hence whether formation logging operations should commence).

According to a third aspect of the invention there is provided a method of deploying a logging tool in a wellbore using an apparatus as defined herein, the method comprising the steps of:

(i) running the downhole transducer, the processor, the release tool actuator, the activatable tool and the modulating valve to a downhole location on a length of drillpipe defining the conduit;

(ii) operating the pump under control of the control device to:

(a) circulate the wellbore; and (b) generate one or more changes in fluid pressure, in the conduit, that are detectable by the downhole transducer whereby the downhole transducer generates one or more detected pressure signals that are indicative of the generated fluid pressure changes such that the processor generates one or more actuator commands that cause operation of the tool actuator so as to activate at least part of the activatable tool at the downhole location, activation of the activatable tool causing the modulating valve to modulate the pressure of fluid in the conduit; and (iii) detecting the modulation of fluid pressure in the conduit at the remote location by means of the remote transducer.

Advantages of the apparatuses of the invention described hereinabove inure to the aforementioned method.

Preferably the sub-step of operating the pump to generate one or more changes in fluid pressure in the conduit includes the further sub-step of generating a waveform, in the fluid in the conduit, that is detectable at the remote location.

Conveniently the sub-step of operating the pump to generate one or more changes in fluid pressure in the conduit includes the further sub-step of generating a sequence of digital pressure pulses in the fluid in the conduit; and the operation of the modulating valve includes the generation of one or more analogue pressure changes in the fluid in the conduit.

In other words the method of the invention preferably involves a combination of digital and analogue signals generated in wellbore fluid. The digital signals are employed when it is appropriate to do so (for example when transmitting simple data intended to initiate deployment of a logging tool). The analogue signals are used to indicate prevailing conditions at a downhole location.

Conveniently the step (i) includes the step of running mutually engaged latch parts, that secure at least part of the activatable tool and the drillpipe together, to the downhole location. This aspect of the method permits the use of a modified version of the per se known garaging tool deployment technique.

Preferably during the step of running the mutually engaged latch parts to the downhole location at least part of the activatable tool is retained in the retracted position relative to the drillpipe; and on operation of the release tool actuator at least part or all of the activatable tool moves relative to the drillpipe so as to protrude from the downhole end thereof.

It is also preferable that operation of the release tool actuator causes disengagement of the mutually engageable latch parts from one another.

The method of the invention also advantageously includes engagement of a landing dog secured to the activatable tool with a landing stop secured on the drillpipe.

Such engagement of a landing stop and a landing dog ensures that the activatable tool does not detach from the drillpipe in which it is conveyed to a downhole location.

Conveniently, following engagement of the landing dog and the landing stop, one part of the activatable tool moves relative to another part, such relative movement between parts of the tool being subject to one or more of:

deceleration by virtue of deformation of a resiliently deformable member and/or damping by forcing of a fluid via an orifice into an expandable chamber.

As noted hereinabove, these aspects of the method prevent potential damage to the components of apparatus carrying out the method of the invention by virtue of sudden deceleration of a large mass of borehole fluid and toolstring components. The damping using the orifice additionally helps to prevent the generation of spurious acoustic signals in the borehole fluid.

In addition the aforesaid damping and deceleration assist in the generation of the tool release and landing signals.

The method of the invention preferably includes operation of a servomechanism to move an actuator member to cause operation of the modulating valve, operation of the servomechanism being dependent on the generation of signals by the processor.

The use of a servomechanism to operate a modulating valve ensures accuracy of such operation. It also allows the use of a self-contained apparatus for carrying out the steps of the method, including an on-board power supply for powering the servomechanism.

Preferably the method of the invention includes the sub-step of pumping at least part of the activatable tool between retracted and protruding positions relative to the downhole end of the drillpipe, using the pressure of fluid circulating in the wellbore.

More specifically the pumping of at least part of the activatable tool includes causing fluid under pressure in the conduit to act on at least one flexible, annular sealing member encircling a cylindrical part of the activatable tool so as slidingly to seal between the exterior of the tool and the interior of the conduit.

These aspects of the method of the invention advantageously make use of the circulating borehole fluid pressure to cause deployment of a logging tool.

Optionally the method also includes opening of a pressure release valve to vent fluid pressure from within a hollow part of the activatable tool if the pressure within the hollow part exceeds a predetermined threshold value.

Preferably the method of the invention includes balancing of fluid pressure in the hollow portion and fluid pressure in the conduit. Such balancing reduces the energy demand of the components needed to carry out the method steps.

In a particularly preferred embodiment of the invention activation of the activatable tool includes activation and operation of a formation pressure tester.

Conveniently activation of the formation pressure tester includes:

(iv) unlatching of the mutually engageable latch parts;

(v) landing of one or more landing dogs in a landing stop;

(vi) deployment of one or more deployable components of the formation pressure tester; and (vii) powering up and/or self testing of the formation pressure tester and wherein the method includes causing the modulating valve to generate signals in the fluid in the conduit that are indicative of one or more of (iv) to (vii).

Consequently the method of the invention is capable of signalling correct deployment of a logging tool.

The method of the invention also typically includes logging of data characteristic of a wellbore using a downhole logging tool; and recording of logged data using a downhole memory device. Subsequently the method typically includes the step of recovering the downhole memory device to an uphole location following the recording of data; and the subsequent analysis, modification, display and/or transmission of the recorded data.

Such steps highlight the versatility of the method of the invention, since the use of a downhole memory device obviates the need to try and transmit large amounts of complex formation data in digital form to an uphole location.

The method also preferably includes the steps of detecting changes in the pressure of fluid in the conduit, using a transducer at a location remote from the downhole transducer; the method further including generating one or more signals indicative of such detections of pressure changes. Consequently the method of the invention is capable of indicating to eg. a surface-located, human operator the initiation or completion of various actions at a downhole location.

In a preferred embodiment of the invention the method includes as necessary powering the downhole transducer, the processor, the release tool actuator, the modulating valve and the activatable tool using a power source conveyed to the downhole location.

According to a fourth aspect of the invention there is provided a method of signalling between a downhole location in a wellbore and a further location that is remote therefrom, the method comprising the steps of:

pumping fluid, using a pump, in a conduit extending into the wellbore so as to pressurise fluid in the conduit;

operating a modulating valve at the downhole location to modulate the pressure of fluid in dependence on signals generated by a processor at the downhole location, the signals being characteristic of conditions at the downhole location; and detecting modulations in the pressure of fluid in the conduit, resulting from operation of the modulating valve, at the further location.

More specifically the modulations caused by operation of the modulating valve are analogue mimics of data logged by the logging tool, especially data indicative of prevailing wellbore conditions. Such data are readily transmissible as narrow bandwidth signals that do not require a complex or high level transmission language.

Conveniently the processor is operatively connected to a servomechanism that when activated causes operation of the modulating valve by means of an actuator member, the method including causing the processor to operate the modulating valve.

Preferably the method includes the step of storing data logged by the logging tool in a memory device at the downhole location.

Even more specifically, the method includes the step of logging data indicative of the pressure of fluid proximate the wellbore at the downhole location, using a formation pressure tester.

Advantages of steps as aforesaid are set out herein in relation to other aspects of the apparatus and method of the invention.

Conveniently the modulations effected by the modulating valve in the case of a good pressure test include:

- an initial pressure increase that mimics sealing of the formation pressure tester pad against the borehole;
- a subsequent pressure decrease caused by operation of the pretest piston of the formation pressure tester that mimics exposure of the formation pressure tester transducer to formation fluid pressure; and
- a subsequent pressure recovery that mimics the building up of formation fluid pressure within the formation pressure tester.

Another possibility is for the modulations effected by the modulating valve in the case of the formation pressure tester experiencing a "no-seal" formation to include:

- a period of substantially invariant fluid pressure that mimics the fluid pressure experienced by the formation pressure tester when carrying out a test that fails to seal.

Yet a further possibility is for the modulations effected by the modulating valve in the case of the pressure tests encountering a tight formation to include:

- a pressure drop that mimics the fluid pressure experienced by the formation pressure tester when carrying out a pressure test on a tight formation; and a subsequent period without a substantial pressure recovery.

Thus the method of the invention is suitable for signifying whether a pressure test is correctly deployed to obtain good test data; or whether an operator or a control device should act to adjust the position of the formation pressure tester away from a no-seal or tight formation area of the wellbore.

The method of the invention may optionally include powering the modulating valve, the processor and the logging tool using a source of electrical power at the downhole location. Thus the method of the invention is suited to being carried out by a wireless, compact, battery/memory logging tool of a kind that is in general known.

BRIEF DESCRIPTION OF THE DRAWINGS

There now follows a description of preferred embodiments of the invention, by way of non-limiting example, with reference being made to the accompanying drawings in which.

DETAILED DESCRIPTION OF THE INVENTION

Figure 1:
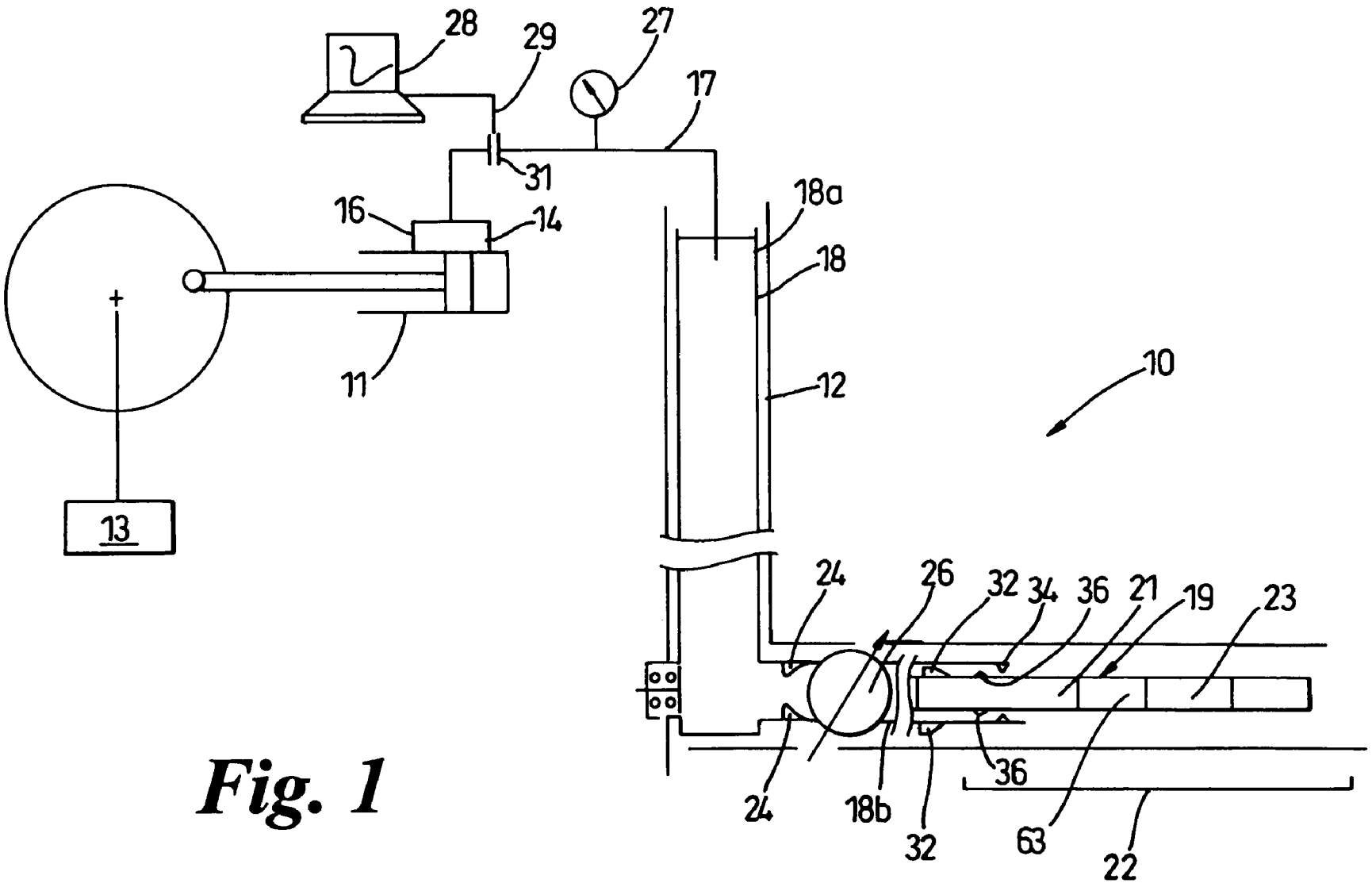
FIG. 1 is a schematic overview of apparatus according to the invention.

Referring to FIG. 1, apparatus 10 according to the invention includes a positive displacement pump 11 of a per se known kind for circulating fluid under pressure in a wellbore 12. A control device such as a microprocessor or other programmable device 13 controls the speed at which pump 11 pumps fluid in the wellbore 12.

Pump 11 is connected via appropriately valved connections 14, 16 in a per se known manner for circulating fluid in wellbore 12.

Programmable device 13 is in the embodiment of the invention shown capable of adjusting the output of pump 11 to provide a constant flow rate regardless of the fluid pressure in the wellbore 12. Techniques for achieving a constant flow rate pump output are known to those skilled in the relevant art.

The connections 14, 16 are connected as shown in FIG. 1 to a standpipe 17 that in the embodiment shown is at surface level, such that it is possible to gain physical access to the pressure in standpipe 17.

The end of standpipe 17 remote from pump 11 is connected in a fluid-transmitting, pressure-tight manner to a conduit in the form of drillpipe 18.

As shown schematically in FIG. 1, drillpipe 18 extends into the wellbore 12.

It is known in the oil and gas production art that the extent to which a drillpipe protrudes into a wellbore is controllable, by virtue of the addition and/or removal of drillpipe joints at the uphole (surface) end 18*a* thereof. As a result it is common for the downhole end 18*b* of the drillpipe to be several hundreds or thousands of meters removed from the uphole end 18*a*.

As represented schematically in FIG. 1, the wellbore 12 is unlikely to be straight, parallel sided and of constant diameter along its entire length.

The use of drillpipe as part of the apparatus of the invention is preferred; but it is possible for the conduit represented by reference numeral 18 in FIG. 1 to take other forms if desired.

For example conduit 18 could in alternative embodiments of the invention be a length of so-called "coiled tubing" techniques for the deployment of which are known to those skilled in the oil and gas production arts.

At its downhole end 18*b* drillpipe 18 supports several components, forming part of the apparatus of the invention, that are for convenience shown in schematic form. Several of such components 21, 23 are in practical embodiments of the invention constituted as part of a logging toolstring 19

Toolstring 19 includes a transducer 21 that in use of the apparatus 10 is near the downhole end 18*b* of drillpipe 18, but that is moveable towards uphole end 18*a* of drillpipe 18 during and following data logging operations.

Transducer 21 is a pressure transducer such as, but not limited to, a strain gauge that is capable of detecting changes in the pressure of fluid surrounding it within drillpipe 18.

An electronics section 23 of toolstring 19 contains various electronic components including a processor that is capable of generating one or more actuator commands, whereby to control one or more actuators located at the downhole end 18*b* of drillpipe 18; and a memory device such as a flash memory that is capable of logging data relating to the geological formations that the wellbore 12 perforates.

The downhole components constituting the toolstring 19 include a source of electrical power, in the form of a battery section 63.

An actuator represented schematically by reference numeral 24 is shown supported on the interior of drillpipe 18, a short distance uphole from end 18*b*.

In practice the apparatus of the invention may include more than one actuator. The actuators may be variously located on the drillpipe and/or the toolstring, depending on their precise function. For the purpose of the overview represented by FIG. 1, a single pair of fixed latching detents 24 and corresponding, moveable dogs 32 represent the actuator function in the apparatus 10. In a practical embodiment of the invention, such as the arrangement shown in FIG. 2, there might typically be three latching detents that are equi-spaced about the hollow interior of the drillpipe for example by means of a sleeve 51 inserted into the drillpipe end, and in which the detents 24 are formed as angled perforations.

Toolstring 19 exemplifies an activatable tool that in use of the apparatus occupies a downhole position.

Shown schematically in the drillpipe between latching arms 24 and downhole end 18*b* is a modulating valve 26. Modulating valve 26 is capable of modulating the pressure of fluid in the drillpipe 18 in a manner described in more detail below.

Operation of modulating valve 26 to modulate fluid pressure in the drillpipe depends on the occurrence of one or more downhole events such as commencement of the deployment of toolstring 19; completion of the deployment of toolstring 19; and commencement of operation of a logging tool such as a formation pressure tester that is not visible in FIG. 1.

Apparatus 10 additionally includes a remote transducer that is connected to detect pressure of fluid in the conduit at a location remote from downhole transducer 21.

The remote transducer is shown in FIG. 1 as a pressure gauge 27 connected to indicate the pressure of fluid in standpipe 17. In practical embodiments of the invention the remote transducing function would additionally be provided by a processor such as laptop computer 28 shown connected via a suitable data cable 29 to a transducing device such as but not limited to a piezoelectric transducer or strain gauge 31, the various components being schematically shown operatively connected to measure and record fluid pressures in standpipe 17.

As is known in the relevant art, it is a common practice when carrying out operations at a downhole location to circulate the wellbore 12 with a pressurised fluid intended to perform various functions in the wellbore.

The composition and nature of wellbore fluids varies greatly from wellbore to wellbore. Methods within the scope of the invention include the use of a great variety of such fluids.

Control device 13 is programmable and in accordance with the invention is programmed to cause pump 11 to circulate wellbore 12 with fluid under pressure.

The precise fluid pressure is dictated by numerous factors such as the nature of the wellbore fluid and the conditions prevailing at various downhole locations in wellbore 12. It is typical for the pressure of fluid circulating in wellbore 12 to be for example several thousand pounds per square inch (psi). The precise fluid pressure is chosen to permit circulation of the particular well under investigation.

Pump 11 is capable of generating such pressures in the wellbore fluid.

Control device 13 is programmed in accordance with the invention to cause the pump 11 to generate digital or analogue acoustic signals, in the form of pressure pulses, by way of modulation of the prevailing fluid pressure in wellbore 12.

Figure 3:
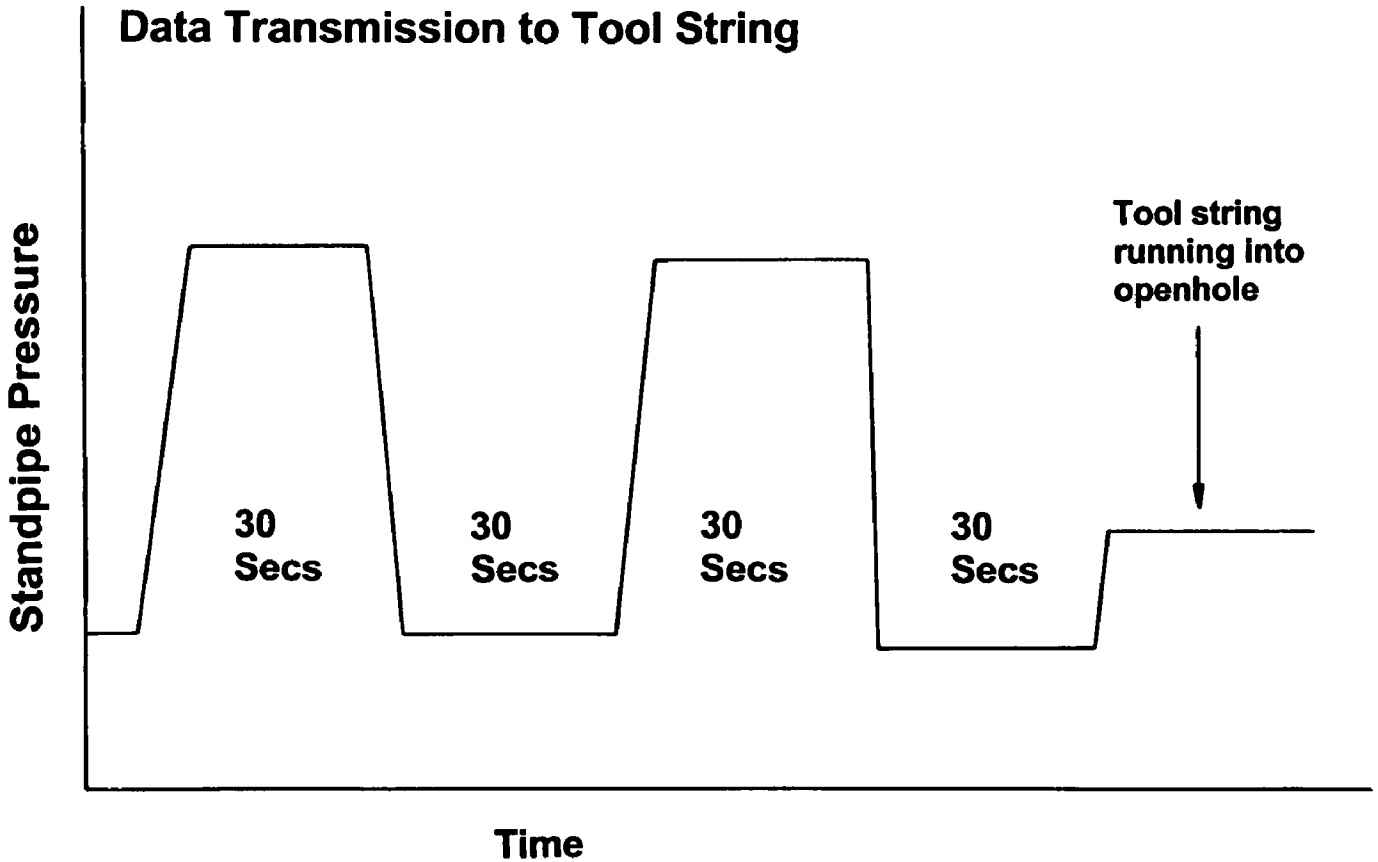
FIG. 3 is a plot of standpipe pressure against time in apparatus according to the invention, illustrating a series of acoustic signals that are transmissible in accordance with the method of the invention.

FIG. 3 shows a sequence of pressure pulses that pump 11 under the control of device 13 is capable of generating in the wellbore fluid.

FIG. 3 plots the pressure detected in standpipe 17 against time. As shown, the pressure pulses are in the preferred embodiment of the invention digital pulses each having a timebase of 30 seconds.

Other sequences of pressure pulses are possible within the scope of the invention.

FIG. 3 shows the modulating effect of the control device 13 on the fluid pressure. FIG. 3 is not intended to indicate absolute wellbore fluid pressure values.

In contrast to pump 11, modulating valve 26 is capable of producing analogue acoustic signals in the form of pressure pulses in a manner described in more detail hereinbelow.

As noted, drillpipe 18 is moveable within wellbore 12. Various techniques are known for adding and removing joints of drillpipe so as to vary the extent to which drillpipe 18 protrudes into wellbore 12.

Toolstring 19 includes at its uphole end one or more latching dogs 32 that during running in of the drillpipe 18 into wellbore 12 engage with the latching detents 24 so as to retain toolstring 19 in a retracted position in which it lies completely within drillpipe 18.

Movement of the latching dogs 32 in a predetermined manner causes them to disengage from latching detents 24. This allows the toolstring 19 to be pumped in a downhole direction by the pressurised fluid within drillpipe 18, so that the major part of toolstring 19 protrudes from the downhole end 18*b* thereof as shown in FIG. 1.

Latching dogs (ie. arms) 32 operate under the control of a release tool activator 33 that is not visible in FIG. 1 but is described in more detail hereinbelow.

The release tool activator 33 is in turn controlled by the programmable device represented schematically by electronics section 23 of toolstring 19. The programmable part of electronics section 23 is in accordance with the invention programmed to cause disengagement of the latching dogs 32 from the latching detents 24, in the event of the downhole transducer 21 detecting a predetermined sequence of acoustic signals in the borehole fluid. Preferably the predetermined sequence of acoustic signals is that shown in FIG. 3, that is a simple series of digital pressure pulses the number of which is controlled.

The simple sequence represented by FIG. 3 may be simply and reliably generated by the pump 11, and does not require a complicated communications protocol or language.

Downhole end 18*b* of drillpipe 18 includes on its interior surface a landing stop in the form of an annular landing collar 34. Toolstring 19 includes a further annular landing collar 36. The landing collars 34 and 36 are mutually engageable upon the toolstring 19 being pumped beyond its position shown in FIG. 1 protruding from downhole end 18*b* of drillpipe 18. The primary purpose of such engagement is to prevent the toolstring 19 from separating completely from the end of drillpipe 18.

The overview of the structure of apparatus 10 represented by FIG. 1 indicates that in simple terms the apparatus performs a modified version of the garaging technique for the deployment and use of logging tools.

The essence of such use of the apparatus lies in part in the running in of drillpipe with the latching detents 24 serving to retain the toolstring 19 within downhole end 18*b*. This allows the running in over the majority of the depth of the well at tripping speed, thereby minimising rig time. Additionally the latching of the toolstring within the drillpipe allows rotation of the latter. This assists the running in operation.

When the downhole end 18*b* of drillpipe 18 approaches the TD of the well the rate of running in is reduced and then stopped as the TD is tagged. Throughout this process the pump 11 circulates the well in accordance with commands from control device 13.

Various methods of determining the drillpipe depth are possible within the scope of the invention. Regardless of the precise drillpipe depth measuring technique adopted, the next stage in operation of the apparatus involves the generation of digital pressure pulses as exemplified by FIG. 3.

Transducer 21 detects the pressure pulses at the downhole end of the wellbore 12. Assuming that the electronics section 23 identifies the sequence of pressure pulses, according to its programming, as being indicative of a need to deploy the toolstring 19, the latching dogs 32 are withdrawn temporarily to free them from the detents 24 and allow them to pass through the drillpipe 18. The toolstring 19 is then pumped out of the downhole end 18*b* into the openhole section 22 of wellbore 12, until the landing collar 36 engages the landing collar 34 in order to retain the toolstring 19 in position ready to log the formation in the vicinity of open hole section 22.

Referring now to FIGS. 2*a* to 2*e*, there is shown an embodiments of apparatus according to the invention that illustrates the above-described principles in more detail and additionally includes numerous further features that are within the scope of the invention.

FIG. 2 shows a toolstring 19 prior to its deployment from the drillpipe 18.

The uphole end of toolstring 19 includes a hollow, cylindrical body 37 that is open at its uphole end 38 to allow the circulation of fluid within cylindrical body 37.

The downhole section 39 of toolstring 19 is constituted by an essentially non-hollow cylinder supporting a plurality of toolstring sections.

At its extreme downhole end downhole section 39 may include a formation pressure tester. The formation pressure tester is, for simplicity, omitted from FIG. 2. However the formation pressure tester preferably is of a per se known design. As noted, the formation pressure tester could be augmented or replaced by one or more other logging tools.

The formation pressure tester is deployable from a compact configuration, in which all the parts of the formation pressure tester lie within an annular housing at downhole section 39 of toolstring 19; and an active position.

In the latter position of the formation pressure tester, one or more calliper arms protrudes radially outwardly therefrom to press an annular pad against the wall of wellbore 12 (that is omitted from FIG. 2 for clarity). The formation pressure tester includes for this purpose a further pressure transducer (that is omitted from FIG. 2).

The formation pressure tester includes an electronics section that is known per se.

A further electronics section 23, whose function is to control operation of modulating valve 26 that is described in more detail below, includes a programmable device in the form of a microprocessor; a memory device arranged to store data logged by the formation pressure tester; and an on-board power source in the form of a plurality of series- and parallel-connected batteries. The formation pressure tester and the components of the electronics section 23 are appropriately wired to one another so as to permit acquisition of data generated by the transducer in the formation pressure tester and its storage in the memory device.

Electronics section 23 is connected at its uphole end to a servomechanism consisting, in the embodiment shown, of an electric motor 42 whose rotary output shaft 43 is connected via an uphole gearbox 44 to a threaded lead screw 46 and ball nut 46*a* that convert the rotary output motion of motor 42 to linear form. At least the microprocessor of electronics section 23 is wired to the servomechanism such that the servomechanism operates under the command of the microprocessor. In practical embodiments of the invention it also is desirable for the memory device to be directly or indirectly connectable to the inputs of the servomechanism, so that (as desired) the servomechanism is operable in dependence on logged data stored in the memory device.

An actuator shaft 47 is secured to the uphole end of ball nut 46*a* and extends longitudinally through the hollow part 38 of the cylindrical body 37. Consequently actuator shaft 47 is moveable longitudinally in body section 38.

Downhole pressure transducer 21 is located adjacent the downhole end of electric motor 42. Transducer 21 is mounted within hollow body section 38 on the downhole side of a pressure balancer 48 described in more detail below.

At the uphole end of actuator shaft 47 the latching arms 32 pivotably secured thereto are, in the position of the apparatus shown in FIG. 2, engaged with latching detent perforations 24 described schematically in relation to FIG. 1. The perforations 24 are formed in the aforementioned sleeve 51 that is secured eg. 3 or 4 drillpipe joints uphole of the downhole end of the drillpipe 18. As is visible in FIG. 2*a* the perforations 24 are angled relative to the longitudinal axis of the apparatus. The latching arms 32 include similarly angled protuberances 32*a* so that the arms 32 are capable of, before its deployment, retaining the toolstring 19 in the drillpipe 18 in a harpoon-like manner as shown.

At its uphole end, actuator shaft 47 terminates in a release tool 49 comprising the hollow sleeve 51 within which the free, uphole end 52 of actuator shaft 47 is longitudinally slideable. The uphole end 52 of shaft 47 protrudes into sleeve 51. Within sleeve 51 shaft 47 terminates in an activator cam 33 that is engageable with the latching arms 32 to cause their release from the detent perforations 24.

Operation of the electric motor 42 under the control of the processor in the electronics section 23 causes shaft 43 to rotate. Lead screw 46 and ball nut 46*a* convert such motion into longitudinal, linear motion of actuator shaft 47.

Upon the processor sending an appropriate command to motor 42, cam 33 therefore moves longitudinally within sleeve 51 towards the latching arms 32.

The three release arms 32 are pivotably secured within the release sleeve 51. On such movement of cam 33 towards latching arms 32 the cam 33 engages the arms 24 and causes them to pivot out of engagement with the latching perforations 24, following shearing of shear pins 56 that retain the latching arms 24 in place until such movement of cam 33 as aforesaid.

On the cam 33 engaging the latching arms 32 the toolstring 19 is released with the result that it is free to slide towards the right of FIG. 2.

At its uphole end the exterior of cylindrical portion 38 is encircled by a pair of per se known swab cups 57, 58. On such releasing of toolstring 19 following withdrawal of the latching arms 24 and release arms 32 the pressure of fluid in the drillpipe 18 acts on the swab cups 57, 58 and drives the toolstring 19 towards the right of FIG. 2 so that the components forming part of downhole section 39 protrude from the end of the drillpipe 18 in the manner outlined in connection with FIG. 1.

Intermediate its two ends actuator shaft 47 has secured thereon a valving member 59 including a circular, conical valving surface 61 that is seatable in a valve seat 62. Member 59 and seat 61 constitute the modulating valve 26 shown schematically in FIG. 1. Conical valving surface 61 constitutes a somewhat large diameter, proportional valve needle.

Valving member 59 is rigidly secured to the exterior of actuator shaft 47. Consequently the longitudinal movement of actuator shaft 47 to the left and right in FIG. 2 respectively causes unseating and re-seating of the valving member 59 in the seat 61.

As is evident from FIG. 2, unseating of the valve surface 61 from the seat 62 opens a fluid flow path via a chamber 64, whence the fluid under pressure vents from within the tool via one or more radial ports 66 perforating cylindrical body 37.

Consequently opening of the modulating valve 26 causes a drop in the fluid pressure in the drillpipe 18. Such a pressure drop is detectable by the remote transducer 27 or 31 at the standpipe 17, and is proportional to the extent of unseating of the valve 26.

On re-seating of the valving member 59 on the seat 62 the flow of fluid via port 66 is blocked. Consequently the pressure in the drillpipe 18 increases, again in a proportional manner. This too is detectable by means of the transducer 27/31 at the uphole, standpipe location.

Movement of the toolstring 19 to the right of FIG. 2 (ie. release of the toolstring as aforesaid) also causes a detectable pressure drop in the drillpipe 18, by virtue of removal of the blockage in drillpipe 18 caused by the presence of the toolstring in its latched position. Such a pressure drop is indicative of tool release.

In FIG. 2 the landing dogs 36 are shown as an annular collar encircling cylindrical body 37 near its uphole end 38 in the region between the swab cups 57, 58 and the modulating valve 26.

Immediately uphole of the landing dogs 36 hollow, cylindrical portion 38 is of reduced diameter as signified by reference numeral 69 and is encircled by a coiled spring 71.

At its uphole end spring 71 is retained by a further annular collar 72 encircling the cylindrical body 37. Collar 72 is secured to a hollow cylinder 73 on which the swab cups 57, 58 are secured.

Reduced diameter portion 69 is slideable in the manner of a telescope section within cylinder 73, against the resilience of coiled spring 71.

As a consequence of the landing dogs 36 engaging the drillpipe landing collar 34 (that is not visible in FIG. 2), cylinder 73 slides towards landing dogs 36 against the resilience of coiled spring 71. This action gradually decelerates the mass of the toolstring 19 that is, in effect, supported by cylinder 73 during delatching and deployment operations; and also the mass of drillpipe fluid acting on the swab cups 57, 58. The mass of the fluid may be several tonnes, so it is important that the rate of the spring 71 is correctly chosen.

On the downhole side of the landing dogs 36 there is defined, by concentric, hollow, external cylindrical parts 74, 76 and cylindrical body 37 an annular chamber 77. Cylinder 74 is rigidly secured to collar 36.

The cylindrical parts 74, 76 are slideable one relative to another so that the length of chamber 77 is variable.

Adjacent the landing dogs 36 chamber 77 includes an annulus of (in the preferred embodiment) six damper ports 78.

In use of the apparatus annular chamber 77 is charged with drillpipe fluid via the damper ports 78. Upon the landing dogs engaging the landing collar chamber 77 elongates longitudinally by virtue of relative movement between the cylindrical parts 74 and 76, with the result that its volume increases.

As a consequence, fluid is drawn into chamber 77 via the damper ports 78 thereby damping the spring-mass-damper system defined by:

the mass of toolstring 19 and of the fluid acting uphole of the swab cups 57, 58;

the spring 67; and the damper represented by the damper ports 78.

Consequently on landing of the landing dogs 36 in the landing collar (not shown) there is little or no likelihood of oscillation of the toolstring 18 in the drillpipe 18. Consequently the likelihood of spurious, acoustic signals being generated in the drillpipe is reduced or eliminated.

The apparatus of the invention additionally includes a pressure relief arrangement 79 valve that is openable to vent pressure from within a hollow part of the activatable tool should the pressure exceed a predetermined threshold such as 500 psi. In the embodiment shown the pressure relief valve is constituted by features of cylinders 74 and 76. As is evident from FIG. 2, following landing of the landing dogs 36 in the landing collar pressure within the hollow, cylindrical section 37 continues to act on the swab cups 57, 58 tending to drive the toolstring 19 to the right of FIG. 2. This causes sliding of cylinder 76 relative to (by then fixed) cylinder 74. Mutually aligned pressure relief ports 80, 81 perforate cylinders 37 and 74. The pressure acting on swab cups 57, 58 causes the cylinder 76 to move to the right of FIG. 2 to expose pressure relief ports 81 via which pressure within body 37 may vent.

Thus pressure relief valve is arranged to open when landing of the landing dogs in the landing collar occurs. This curtails the increase of pressure within hollow section 37 following landing, in a way that is detectable in standpipe 17.

A secondary pressure relief valve 101 is present downhole of relief valve 79 to allow valve 26 to be disabled and to prevent the drillpipe pulling "wet". The resulting pressures cause a sleeve 102 that is secured to toolstring 19 by means of shear pins 103 to move to the right of FIG. 2 and open one or more normally closed vent ports 104 to allow venting of fluid from within toolstring 19.

The swab cups 57, 58 are, as illustrated, of conventional design. In an alternative arrangement the swab cups may each be effectively a pair of conventional swab cups arranged "back-to-back" in a siamesed frustoconical shape so as to create a flexible, annular bulge encircling the cylindrical part of the drillstring and defining a sliding seal against the interior wall of the drillpipe 18.

Optionally a fishing neck, may be secured at the uphole end of toolstring 19 to permit retrieval of toolstring 19 from the borehole.

Such a fishing neck is when required secured to toolstring 19 before running in of the drillpipe 18.

The fishing neck is perforated whereby to permit circulation of fluid via the hollow interior 37 of uphole section 38 of toolstring 19.

As shown in FIG. 3, the typical digital acoustic signal generated by pump 11 under the control of controller 13 is a series of two pressure pulses each of 30 seconds duration and spaced by pressure decreases each of 30 seconds duration.

The pressure transducer 21 in the toolstring 19 detects such pulses and generates signals indicative thereof. By virtue of the wiring of the transducer such signals pass to the processor in the electronics section 23. Since the processor is programmed to recognise the sequence of pulses it generates commands to the electric servomotor 42 to cause the actuator shaft 47 to move to the left in FIGS. 2 to 5 and initiate release of the toolstring 19 from its retracted position to its operative position.

The diameter of the valving member 59 is such that it is moveable longitudinally in chamber 64 while still maintaining its seated condition. During running in of the drillpipe modulating valve 26 is in its open position (ie. with member 59 unseated from seat 62). On operation of the motor 42 as aforesaid member 59 seats in seat 62 to close modulating valve 26.

The motor 42 then continues to drive the valving member 59 to the left of FIG. 2, causing it to pass more fully into chamber 64. By virtue of the rigid connection of cam 33 to member 59 (by means of shaft 47) this action causes cam 33 to engage the latching arm 32, shear the shear pins 56 and allow release of the toolstring 19.

Figure 4:
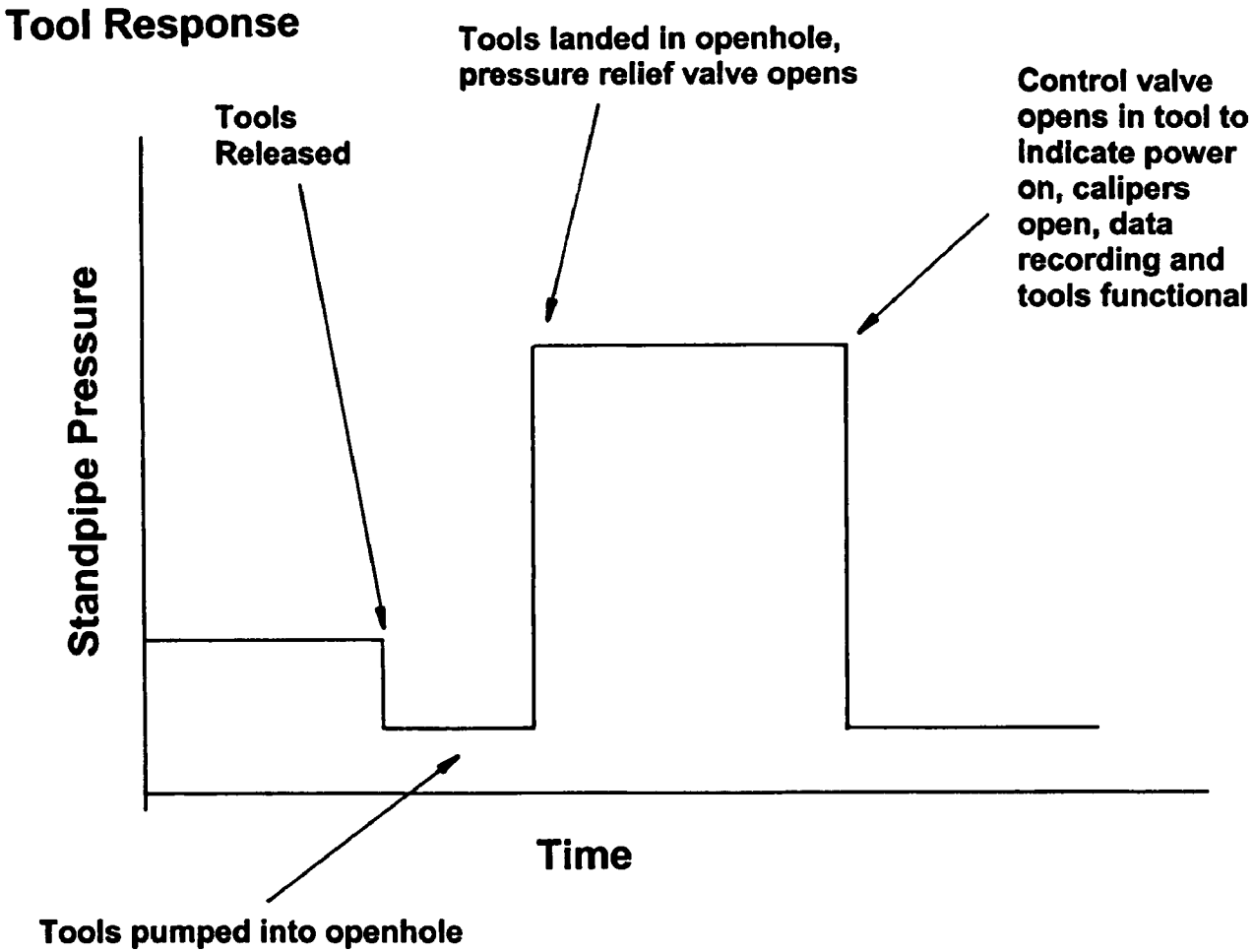
FIG. 4 is a plot of standpipe pressure against time, illustrating the response of a toolstring such as shown in FIGS. 2*a*–2*e* to a series of acoustic signals as illustrated by FIG. 3, the response being detected at an uphole location.

As illustrated in FIG. 4 by "tools released", this causes a drop in the drillpipe fluid pressure that is detectable at the standpipe 17, as the toolstring 19 commences its movement to the right and consequently dethrottles the fluid in drillpipe 18.

FIG. 4 shows that the pressure reduction continues while the fluid pressure acts to pump the toolstring 19 to its deployed position. This period is signified by "tools pumped into openhole" in FIG. 4.

On landing of the landing dogs 36 in the landing collar (not shown) halting of the toolstring causes a pressure build up in the hollow part 38 of toolstring 19 and hence in the standpipe 17. The pressure build up is visible in FIG. 4, as signified by "tools landed in openhole".

Once the pressure within hollow portion 38 of toolstring 19 exceeds the threshold pressure set for the pressure relief valve 79, the latter opens with the result that the standpipe pressure stabilises.

The pressure transducer 21 is capable of detecting this condition. It consequently generates a further signal that is interpreted by the processor in the electronics section 23 to initiate an activation procedure for a logging tool such as but not limited to a formation pressure tester.

The initiation routine of the formation pressure tester can include deployment of a calliper having a pad secured thereto; powering up of the electronic parts of the formation pressure tester; a self-testing routine.

On completion of such activities, such that the formation pressure tester is ready for use, the processor generates commands to the servomechanism causing the valve member 59 to unseat from seat 62 thereby causing a further pressure drop (signified by "control valve opens in tool to indicate power on, callipers open, data recorded and tools functional" in FIG. 4) that is also detectable in standpipe 17.

It follows from the foregoing that in use of the apparatus of the invention it is possible to initiate deployment of downhole components using signals generated at an uphole location. It is subsequently possible for the downhole components to signal correct deployment to the uphole location represented by standpipe 17.

Figure 5:
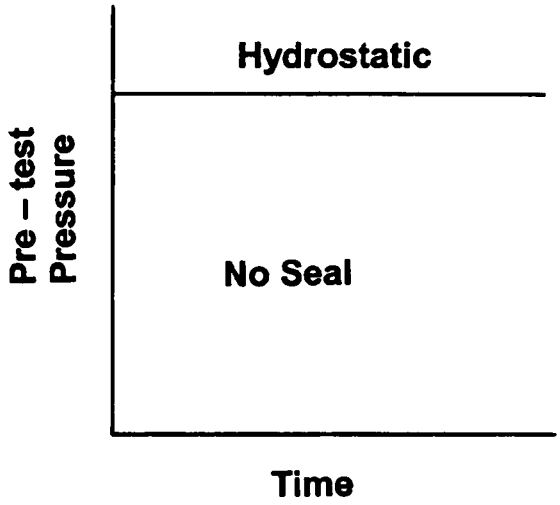
Fig. 5 Prior Art
FIG. 5 shows the typical response of a per se known formation pressure tester when carrying out a so-called "no-seal" test.

FIG. 5 shows the pressure response of the formation pressure tester in the event of it encountering a no-seal condition. In such circumstances the pad fails to seal adequately, for example because of excessive porosity of the surrounding strata.

As indicated in FIG. 5, this leads to a constant pressure response within the formation pressure tester.

Figure 6:
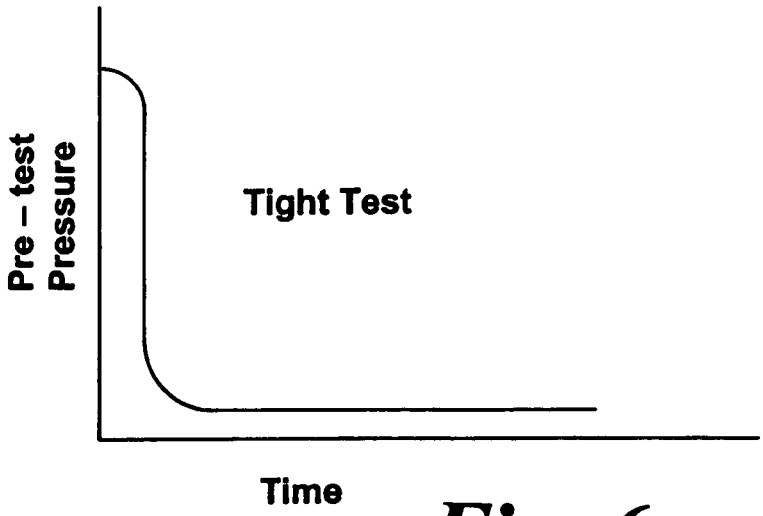
Fig. 6 Prior Art
FIG. 6 shows the response of a per se known formation pressure tester when testing a so-called "tight formation"

FIG. 6 shows the pressure response of the formation pressure tester when encountering a so-called tight formation.

In this circumstance the pad seals correctly against the surrounding strata, and the pretest causes an initial pressure drop with the formation pressure tester. The pressure detected by the formation pressure tester however remains at a lower value thereafter.

Figure 7:
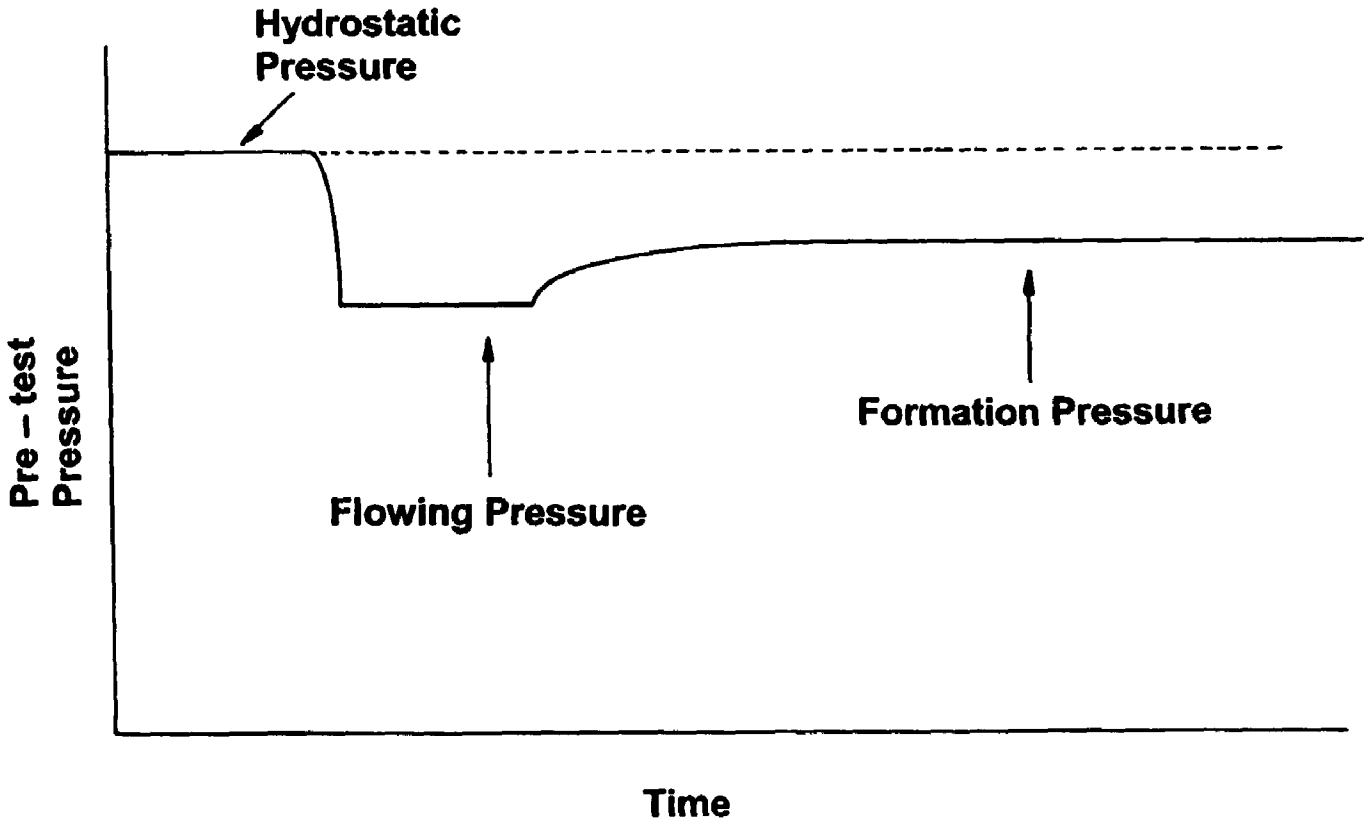
Fig. 7 Prior Art
FIG. 7 shows the response of a per se known formation pressure tester when carrying out a good test.

A good pressure test is illustrated in FIG. 7. In this circumstance the initial pressure drop is followed a short time later by a build up of formation pressure within the active chamber of the formation pressure tester. Such a pressure response in the formation pressure tester represents good data.

The apparatus of the invention is arranged such that the processor in the electronics section 23 analyses the pressure responses of the formation pressure tester, either in real time or following recording of the pressure responses in the memory device forming part of the electronics section. The processor then is capable of commanding the servomotor 42 to open and close the modulating valve 26 in dependence on the formation pressure tester responses. This causes analogue modulation of the drillpipe fluid pressure with the result that the fluid pressure in the standpipe 17 modulates similarly.

Figure 8:
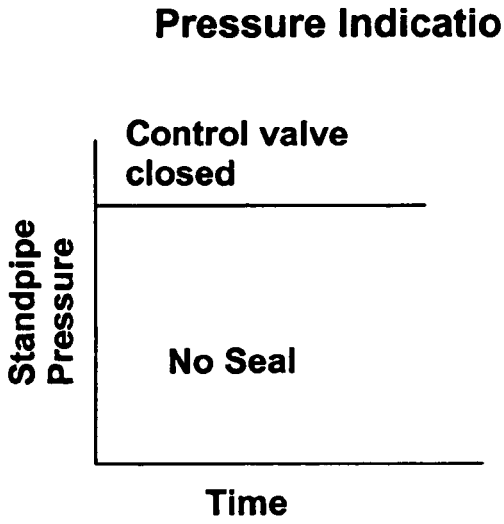
FIGS. 8 to 10 are plots of standpipe pressure against time to illustrate the signalling of formation pressure tester responses as shown in FIGS. 4 to 7 at an uphole location using the apparatuses and methods of the invention.
Figure 9:
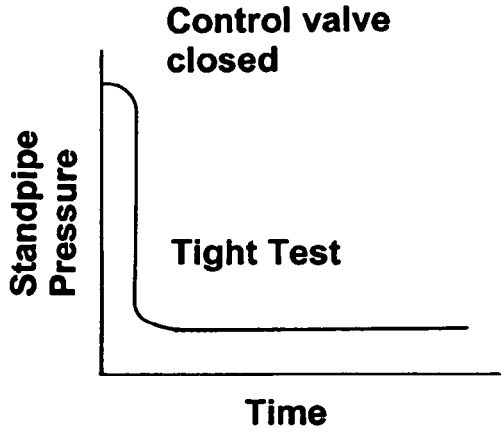
Figure 10:
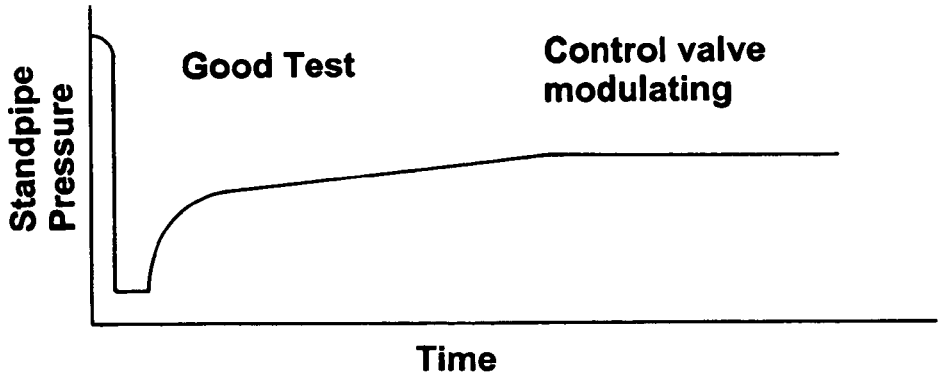

FIGS. 8 to 10 show the standpipe pressures resulting from such operation of the processor, servomotor 42 and modulating valve 26. As is clear from FIGS. 8 to 10 in use of the apparatus of the invention the standpipe pressures closely mimic the actual formation pressure tester responses at the downhole location. Consequently an operator at a surface location (or indeed appropriately programmed software in a control computer) may interpret the standpipe pressure indications in order to ascertain whether conditions are correct for operation of the formation pressure tester.

In the event of the standpipe pressure indication signifying either a no-seal or a tight formation, the operator can run in or withdraw a short length of drillpipe 18 in order to reposition the formation pressure tester (following withdrawal of the pad thereof from the borehole wall) until a region of good formation quality is encountered, as signified by a pressure indication like that of FIG. 10.

Figure 2A:
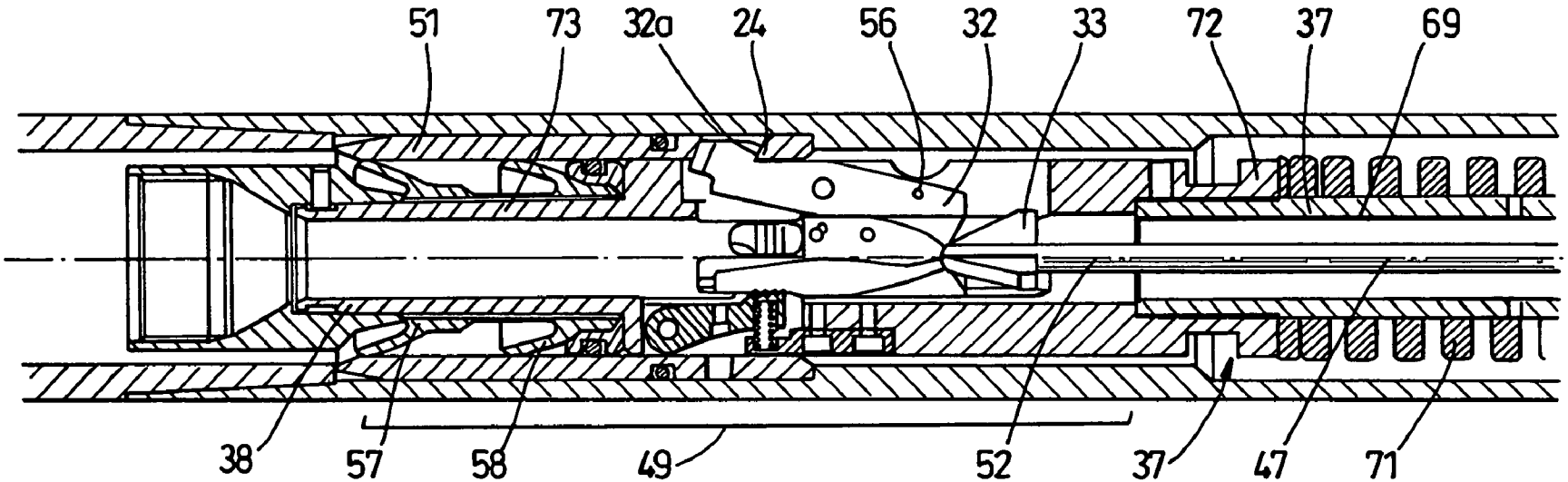
FIGS. 2*a*–2*e* are a longitudinally sectioned view of a toolstring forming part of the FIG. 1 apparatus.
Figure 2B:
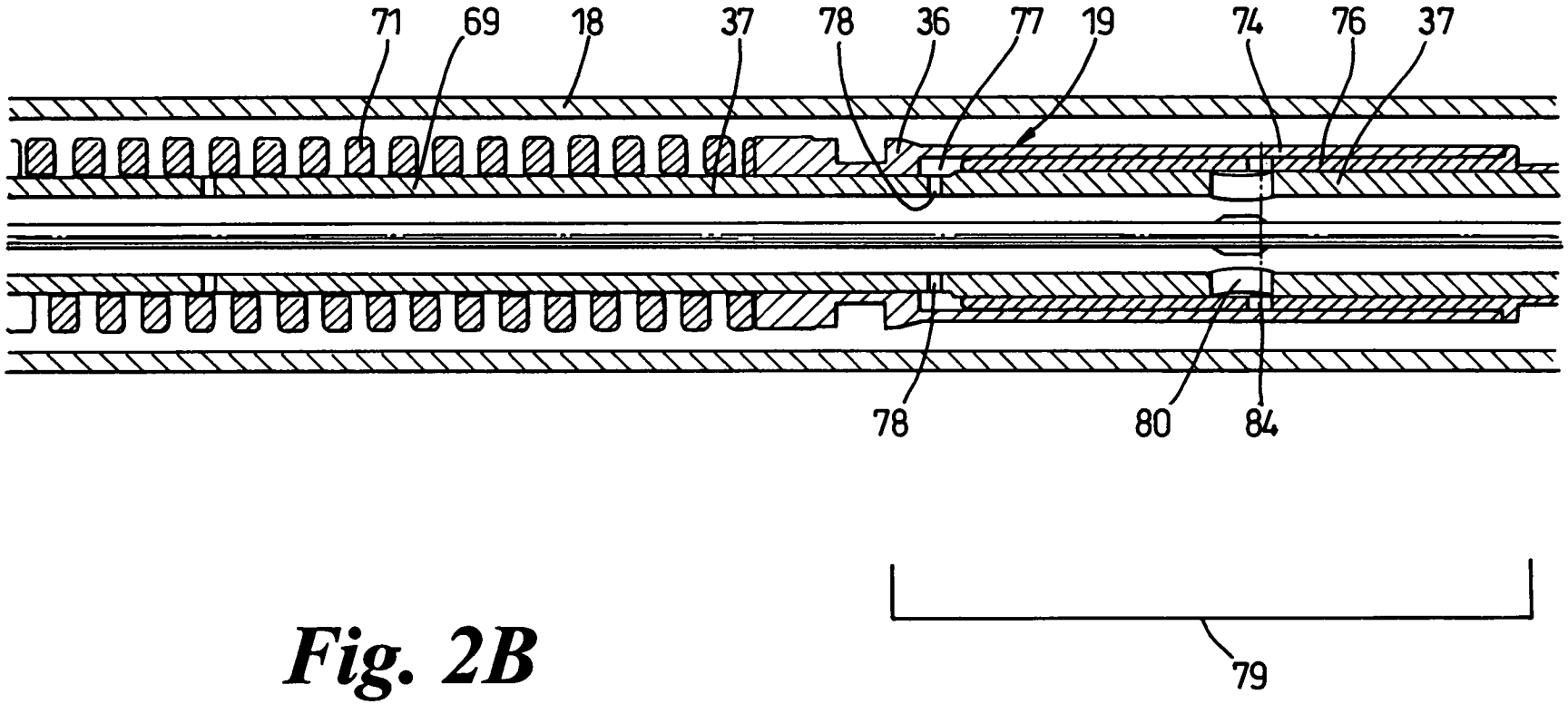
Figure 2C:
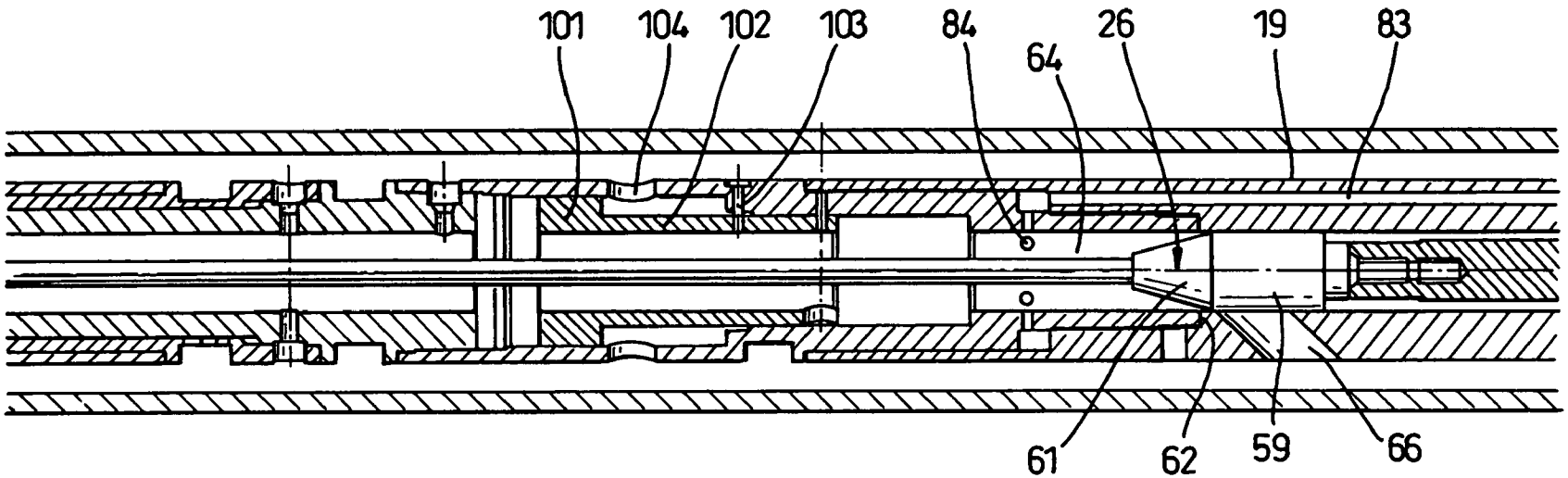
Figure 2D:
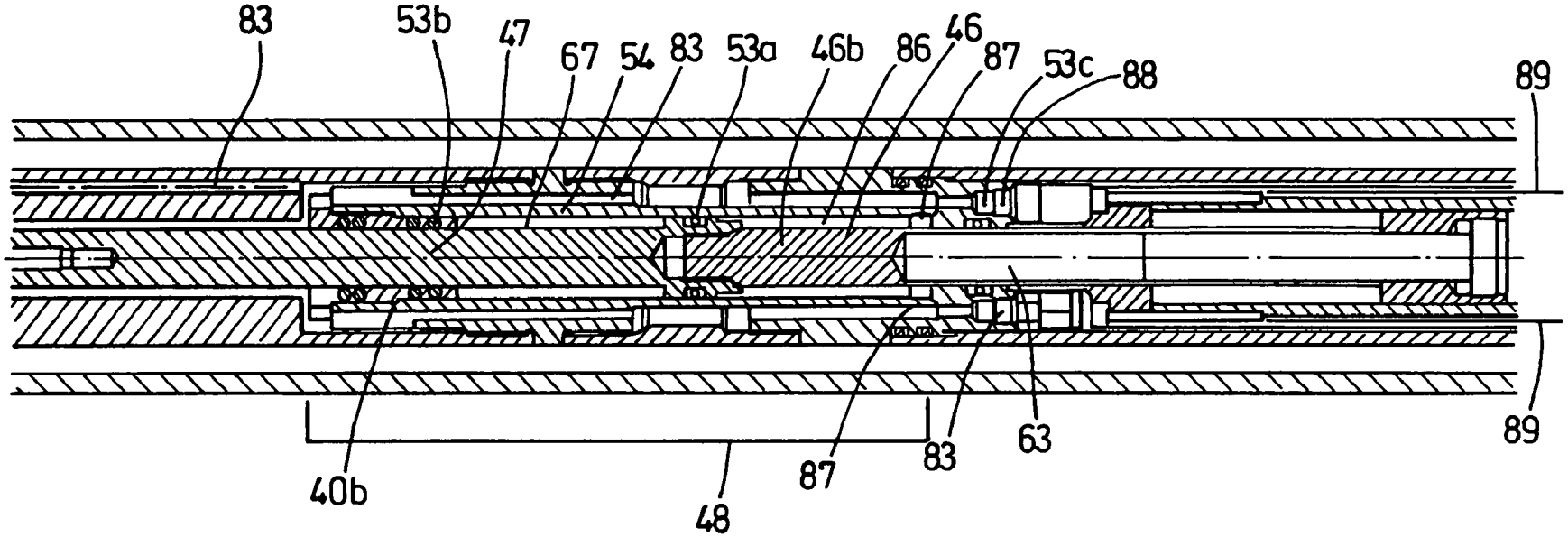
Figure 2E:
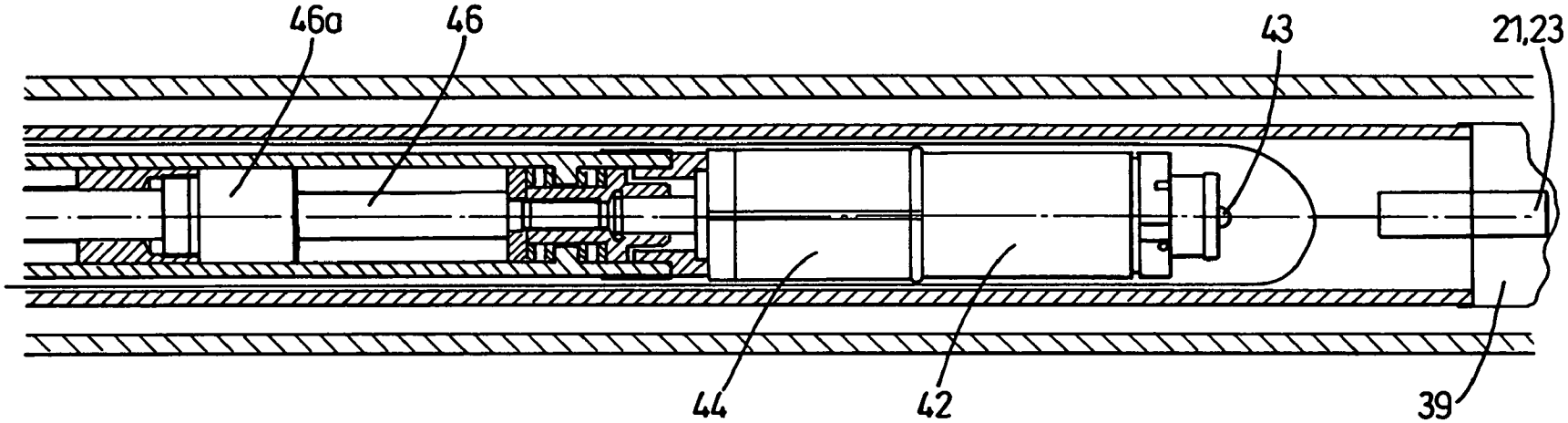

Modulating valve 26 is pressure balanced by virtue of conduit 83 providing drillpipe pressure on both the uphole and downhole ends of valving member 59. Conduit 83 connects to drillpipe pressure via ports 84 as shown in FIG. 2*c*.

A further pressure balancer 48 balances the fluid pressures exerted on lead screw (ball screw) 46.

Pressure balancer 48 includes a hollowed portion 63 of an end cap 46*b* secured on lead screw 46. Hollowed portion 63 is slightly downhole of solid end cap 46*b* that connects to rigid shaft 47. The threaded portion of lead screw 46 is threadedly received in hollow portion 63.

Annular O-ring seal 53*a* seals the uphole end of end cap 46*b* relative to an encircling cylinder 54. A further O-ring seal 53*b* uphole of end cap 40*b*, on shaft 47, defines an annular chamber 67 that is filled with air at atmospheric pressure. Downhole of end cap 46*b* the exterior of chamber 63 is sealed by a third O-ring 53*c* to the wall of toolstring 19.

The hollow portion 63 also contains air at atmospheric pressure. Consequently the borehole pressure acting in an annular chamber 67 encircling end cap 46*b* confers no net force on lead screw 46, as a result of atmospheric pressure acting on the components to either side thereof.

Thus a further annular chamber 86 lies, externally of end cap 46*b*, between O-rings 53*a* and 53*c*. Chamber 86 is connected via ports 87 to conduit 83. Hence borehole (drillpipe) pressure acts in chamber 86.

Conduit 83 extends further downhole to beyond the seals 53*c*.

Conduit 83 terminates at a pressure bulkhead 88 of per se known design. A pair of capillary tubes 89 connect the pressure transducer 21 to the bulkhead 88, whereby transducer 21 is able to detect the various pressure changes in the drillpipe 18.

One mode of use of the device of the invention, is following completion of a natural Gamma log of a borehole. The results of the Gamma log can be stored in the memory device of electronics section 23 before deployment thereof. The electronics section 23 can then cause operation of the modulating valve 26 partly in dependence on the Gamma log data. Consequently the apparatus is able to transmit to the uphole transducer 27 an absolute indication of the position of the toolstring 19 in the borehole at any given time.

The invention claimed is:

1. Apparatus for remotely activating an activatable tool in a wellbore, the apparatus comprising:

a positive displacement pump for causing circulation of a fluid under pressure in the a control device for controlling the speed of operation of the pump;

a conduit that is operatively connected to the pump and extends into the wellbore for conveying the fluid thereinto on operation of the pump;

a downhole transducer, that is capable of detecting changes in the pressure of the fluid and generating one or more detected pressure signals indicative thereof;

a processor that is capable of generating one or more actuator commands in dependence on the detected pressure signals generated by the downhole transducer;

one or more actuators that are each operable to activate at least a part of the activatable tool in dependence on a said actuator command;

an activatable tool at a downhole location;

a modulating valve for modulating the pressure of fluid in the conduit; and a remote transducer that is operatively connected to detect pressure of the fluid in the conduit at a location remote from the downhole transducer, wherein operation of the modulating valve is dependent on a downhole event, wherein the control device is operable to cause the pump to generate one or more digital acoustic signals having waveforms, in the fluid, the waveforms being detectable by the downhole transducer; and wherein the modulating valve is operable to generate one or more analogue acoustic signals, in the fluid, that are detectable by the remote transducer;

wherein the conduit is a drillpipe that is moveable within the wellbore; wherein the activatable tool is moveable relative to the drillpipe; and wherein the drillpipe and the activatable tool include mutually engageable latch parts that, when mutually engaged, retain at least a part of the activatable tool in a retracted position relative to the downhole end of the drillpipe and when disengaged permit movement of the activatable tool to an advanced position in which at least part of the activatable tool protrudes from the downhole end of the drillpipe, the apparatus including a release tool activator that is operable to cause disengagement of the latch parts from one another.

2. Apparatus according to claim 1 wherein the release tool activator is adapted to be controlled by a programmable device that is programmed to cause disengagement of the latch parts on the downhole transducer detecting a predetermined sequence of pressure changes in the fluid.

3. Apparatus according to claim 1 wherein the drillpipe includes on an interior surface thereof one or more landing stops and the activatable tool includes protruding from an exterior surface thereof one or more landing dogs each landing dog being engageable with a said landing stop on the drillpipe, the release of the engagement thereof releasing the activatable tool for moving to the advanced position relative to the drillpipe.

4. Apparatus according to claim 3 wherein each landing stop includes an annular landing collar extending about the interior surface of the drillpipe.

5. Apparatus according to claim 3 wherein the apparatus includes a pressure relief valve having a predetermined opening threshold; and the engagement of each said landing dog with a respective landing stop causes the pressure relief valve to generate an analogue, acoustic signal that is indicative of landing of the activatable tool in the advanced position relative to the drillpipe.

6. Apparatus according to claim 1 wherein operation of the release tool activator to cause disengagement of the latch parts also causes the modulating valve to close whereby movement of the activatable tool to the advanced position causes dethrottling of the flow of fluid at the downhole location, such dethrottling being detectable at the remote location as a period of reduced fluid pressure.

7. Apparatus according to claim 6 wherein the modulating valve is a proportional valve including a valve needle and a valve seat; and acoustic signals generated thereby are fluid pressure decreases that are proportional to the displacement of the valve needle relative to the valve seat.

8. Apparatus according to claim 6 wherein the modulating valve is a proportional valve including a valve needle and a seat therefor; and the acoustic signal is an increase in pressure that is proportional to the displacement of the valve needle relative to the seat.

9. Apparatus according to claim 6 including an actuator member that is common to the release tool activator and the modulating valve whereby operation of the release tool activator causes movement of the modulating valve.

10. Apparatus according to claim 9 wherein the actuator member is a rod extending centrally within a toolstring, having mutually spaced parts being secured respectively to the release tool activator, the valve member of the modulating valve and a servomechanism that moves the rod longitudinally in the toolstring in dependence on one or more said actuator commands.

11. Apparatus according to claim 10, wherein the activatable tool includes one or more reaction surfaces against which fluid pressure in the conduit acts.

12. Apparatus according to claim 11 wherein the reaction surfaces include one or more flexible, annular sealing members encircling a cylindrical part of the activatable tool so as to seal between the exterior of the activatable tool and the interior of the drillpipe.

13. Apparatus according to claim 11 wherein each reaction surface is moveable longitudinally of the activatable tool relative to the landing dogs; and the apparatus includes a resiliently deformable member operatively interconnecting each reaction surface and a said landing dog.

14. Apparatus according to claim 11, wherein the logging toolstring includes a cylindrical member that is moveable relative to a chamber, the chamber including one or more ports providing communication between the interior and the exterior of the chamber and the cylindrical member closing each said port during deployment of the toolstring, each reaction surface being operatively connected to the cylindrical member such that on the protrusion of the activatable tool the cylindrical member moves to open each said port to limit the pressure of fluid in the chamber.

15. Apparatus according to claim 14 wherein the chamber has formed therein an orifice, the orifice providing fluid communication between the conduit and a further chamber the volume of which changes on movement of the cylindrical member.

16. Apparatus according to claim 15 including a pressure relief valve that opens to vent fluid pressure from within a hollow part of the activatable tool should the pressure within the hollow part exceed a predetermined threshold.

17. Apparatus according to claim 16 including a first pressure balancer for balancing fluid pressure in the uphole and downhole sides of the modulating valve.

18. Apparatus according to claim 17 including a further pressure balancer that in use lies downhole of the modulating valve and is operatively connected to equalise pressures acting on the uphole and downhole sides of the servomechanism.

19. Apparatus according to claim 14 further comprising a resiliently deformable member in the form of a coiled spring interconnecting the or each reaction surface and the cylindrical member.

20. Apparatus according to claim 14 wherein the chamber includes a wall member having defined therein each said port, the wall member including a perforated sleeve that is releasably secured on the chamber.

21. Apparatus according to claim 10 wherein the activatable tool includes a formation pressure tester; and wherein the processor is programmed to generate one or more actuator commands for causing operation of the formation pressure tester.

22. Apparatus according to claim 21 wherein the processor is connected and programmed to generate commands for causing one or more of:

(i) operation of the servomechanism to cause unlatching of the mutually engageable latch parts and thereby cause movement of the toolstring, that generates an acoustic signal that is indicative of tool release; followed by (ii) operation of the pressure relief valve;

(iii) deployment of one or more deployable components of the formation pressure tester; and (iv) powering up and/or self-testing or one or more tools in the toolstring.

23. Apparatus according to claim 10 wherein the activatable tool includes a logging device and a memory device capable of recording data logged by the logging device, the processor being programmed to generate actuator commands for commanding the servomechanism to operate the modulating valve to generate fluid pressure signals in dependence on the recorded, logged data.

24. Apparatus according to claim 1, including a remote transducer that detects pressure of the fluid in the drillpipe at a location remote from the downhole pressure transducer and generates signals indicative thereof.

25. Apparatus according to claim 24 wherein the remote transducer detects fluid pressure in a standpipe that interconnects the outlet of the pump and the interior of the drillpipe.

26. Apparatus according to claim 1 also including an on-board source of electrical power.

27. Apparatus according to claim 1:

wherein the drillpipe includes on an interior surface thereof one or more landing stops and the activatable tool includes protruding from an exterior surface one or more landing dogs that are each engageable with a said landing stop on the activatable tool moving to the advanced position relative to the drillpipe;

wherein operation of the release tool activator to cause disengagement of the latch parts also causes the modulating valve to close whereby movement of the activatable tool to the advanced position causes dethrottling of the flow of fluid at the downhole location, such dethrottling being detectable at the remote location as a period of reduced fluid pressure;

wherein the apparatus includes a pressure relief valve having a predetermined opening threshold; and the engagement of the or each said landing dog with a said landing stop causes the pressure relief valve to generate an analogue, acoustic signal that is indicative of landing of the activatable tool in the advanced position relative to the drillpipe; and wherein the modulating valve preferably is a proportional valve including a valve needle and a seat therefor; and the acoustic signal is an increase in pressure that is proportional to the displacement of the valve needle relative to the seat.

28. Apparatus for signaling between a downhole location in a wellbore and a further location that is remote from the downhole location, the apparatus comprising a conduit extending into the wellbore; a pump connected to supply fluid under pressure in the conduit: a modulating valve, at a downhole location, for modulating the pressure of fluid in the conduit; a programmable processor for controlling operation of the modulating valve; a memory device; and a remote transducer for detecting fluid pressure at the further location, wherein the modulating valve is operable to generate one or more analogue acoustic signals, in the fluid, that are detectable by the remote transducer, including a logging tool that is capable of logging data characteristic of the wellbore or a formation proximate thereto, the logging tool and the memory device being connectable one to the other so that the memory device stores data logged by the logging tool, wherein the memory device includes stored therein data logged in the wellbore; and wherein the programmable processor is programmed to cause the modulating valve to modulate the pressure of fluid in the conduit in a fashion that is characteristic of the logged data, wherein the logging tool is a formation pressure tester that is deployable against the wellbore in dependence on commands generated by the programmable processor, wherein the programmable device is programmed to generate signals that cause the modulating valve to generate analogue pressure changes in the fluid in the conduit, the pressure changes mimicking pressure changes experienced by the formation pressure tester in use, wherein the pressure changes generated by the modulating valve includes:

an initial pressure increase that mimics sealing of the formation pressure tester against the borehole;

a subsequent pressure decrease caused by operation of a pretest piston of the formation pressure tester that mimics exposure of the formation pressure tester transducer to formation fluid pressure; and a subsequent pressure recovery that mimics the building up of formation fluid pressure within the formation pressure tester when the pretest is halted.

29. Apparatus according to claim 28 wherein the programmable processor is programmed to cause the modulating valve to modulate the pressure of fluid in the conduit in a fashion that is characteristic of two data logs carried out at different times.

30. Apparatus according to claim 29 wherein the earlier of the two logs is a low frequency Gamma log.

31. Apparatus according to claim 28 wherein the pressure changes generated by the modulating valve includes, in the case of the formation pressure tester experiencing a no-seal condition, a period of substantially invariant fluid pressure that mimics the fluid pressure exerted on the formation pressure tester when carrying out a no-seal test.

32. Apparatus according to claim 28 wherein the analogue pressure changes generated by the modulating valve includes, in the case of the formation pressure tester engaging a tight formation, an initial pressure drop; and a subsequent period without a substantial pressure recovery.

33. Apparatus according to claim 28 including a source of electrical power operatively connected to power as necessary the programmable processor, the modulating valve and the logging tool.

34. Apparatus according to claim 33 wherein the programmable device, the modulating valve, the logging tool and the source of electrical power are secured one to another in a discrete toolstring.

35. A method of deploying a logging tool in a wellbore using an apparatus according to any one of claims 1 and 28, the method comprising the steps of:

(i) running the downhole transducer, the processor, the release tool actuator, the activatable toot and the modulating valve to a downhole location on a length of drillpipe defining the conduit;

(ii) operating the pump under control of the control device to:

(a) circulate the wellbore; and (b) generate one or more changes in fluid pressure, in the conduit, that are detectable by the downhole transducer whereby the downhole transducer generates one or more detected pressure signals that are indicative of the generated fluid pressure changes such that the processor generates one or more actuator commands that cause operation of the tool actuator so as to activate at least part of the activatable tool at the downhole location, activation of the activatable tool causing the modulating valve to modulate the pressure of fluid in the conduit to generate one or more analogue acoustic signals, in the fluid, that are detectable by the remote transducer; and (iii) detecting the modulation of fluid pressure in the conduit at the remote location by means of the remote transducer.

36. A method according to claim 35 wherein the sub-step of operating the pump to generate one or more changes in fluid pressure in the conduit includes the further sub-step of generating a waveform, in the fluid in the conduit, that is detectable at the remote location.

37. A method according to claim 35 wherein the sub-step of operating the pump to generate one or more changes in fluid pressure in the conduit includes the further sub-step of generating a sequence of digital pressure pulses in the fluid in the conduit; and wherein the operation of the modulating valve includes the generation of one or more analogue pressure changes in the fluid in the conduit.

38. A method according to claim 35 wherein the step (i) includes the step of running mutually engaged latch parts, that secure at least part of the activatable tool and the drillpipe together, to the downhole location.

39. A method according to claim 38 wherein during the step of running the mutually engaged latch parts to the downhole location at least part of the activatable tool is retained in the retracted position relative to the drillpipe; and wherein on operation of the release tool actuator at least part, or all, of the activatable tool moves relative to the drillpipe so as to protrude from the downhole end thereof.

40. A method according to claim 39 wherein operation of the release tool actuator causes disengagement of the mutually engageable latch parts from one another.

41. A method according to claim 39 including engagement of a landing dog secured to the activatable tool with a landing stop secured on the drillpipe.

42. A method according to claim 41 wherein following engagement of the landing dog and the landing stop one part of the activatable tool moves relative to another part, such relative movement between parts of the tool being subject to one or more of:

deceleration by virtue of deformation of a resiliently deformable member and damping by forcing of a fluid via an orifice into an expandable chamber.

43. A method according to claims 35 including operation of a servomechanism to move an actuator member to cause operation of the modulating valve, operation of the servomechanism being dependent on the generation of signals by the processor.

44. A method according to claim 35 including the sub-step of pumping at least part of the activatable tool between retracted and protruding positions relative to the downhole end of the drillpipe, using the pressure of fluid circulating in the wellbore.

45. A method according to claim 44 wherein the pumping of at least part of the activatable tool includes causing fluid under pressure in the drillpipe to act on at least one flexible, annular sealing member encircling a cylindrical part of the activatable tool so as slidingly to seal between the exterior of the tool and the interior of the drillpipe.

46. A method according to claim 35 including opening of a pressure relief valve to vent fluid pressure from within a hollow part of the activatable tool if the pressure within the hollow part exceeds a predetermined threshold value.

47. A method according to claim 46 including balancing of fluid pressure in the hollow portion and fluid pressure in the drillpipe.

48. A method according to claim 35 wherein activation of the activatable tool includes activation and operation of a formation pressure tester.

49. A method according to claim 48 wherein activation of the formation pressure tester includes:

(iv) unlatching of the mutually engageable latch parts;

(v) landing of one or more landing dogs in a landing stop;

(vi) deployment of one or more deployable components of the formation pressure tester; and (vii) powering up and/or self testing of the formation pressure tester and wherein the method includes causing the modulating valve to generate signals in the fluid in the drillpipe that are indicative of one or more of (iv) to (vii).

50. A method according to claim 35 including logging of data characteristic of a formation perforated by a wellbore using a downhole logging tool; and recording of logged data using a downhole memory device.

51. A method according to claim 50 including the step of recovering the downhole memory device to an uphole location following the recording of data; and the subsequent analysis, modification, display and/or transmission of the recorded data.

52. A method according to claims 35 including the detecting of changes in the pressure of fluid in the drillpipe, using a transducer at a location remote from the downhole transducer; the method further including generating one or more signals indicative of such detections of pressure changes.

53. A method according to claim 35 including the sub-step of as necessary powering the downhole transducer, the processor, the release tool actuator, the modulating valve and the activatable tool using a power source conveyed to the downhole location.

54. A method according to claims 35 including the step of modulating acoustic signals generated in the borehole fluid with one or more waveforms that are characteristic of a low frequency Gamma log of the borehole.

55. A method according to claim 35 including the step of causing operation of one or more pressure relief valves generally to equalise uphole and downhole fluid pressures acting on one or more components of the apparatus.

56. A method of signalling between a downhole location in a wellbore and a further location that is remote therefrom, the method comprising the steps of:

pumping fluid, using a pump, in a conduit extending into the wellbore so as to pressurise fluid in the conduit;

operating a modulating valve at the downhole location to modulate the pressure of fluid in dependence on signals generated by a processor at the downhole location, the signals being characteristic of conditions at the downhole location; and detecting modulations in the pressure of fluid in the conduit, resulting from operation of the modulating valve, at the further location, wherein modulations in the pressure of fluid are analogue acoustic signals;

also including the step of logging data on the pressure of fluid proximate the wellbore at the downhole location, using a formation pressure tester;

wherein the modulations effected by the modulating valve include:

an initial pressure increase that mimics sealing of the formation pressure tester pad against the borehole;

a subsequent pressure decrease caused by operation of the pretest piston of the formation pressure tester that mimics exposure of the formation pressure tester transducer to formation fluid pressure; and a subsequent pressure recovery that mimics the building up of formation fluid pressure within the formation pressure tester.

57. A method according to claim 56 wherein the modulations caused by operation of the modulating valve are analogue mimics of data logged by the logging tool.

58. A method according to claim 56 wherein the processor is operatively connected to a servomechanism that when activated causes operation of the modulating valve by means of an actuator member, the method including causing the processor to operate the modulating valve.

59. A method according to claim 56 including the step of storing data logged by the logging tool in a memory device at the downhole location.

60. A method according to claim 56 wherein modulations effected by the modulating valve in the case of the formation pressure tester experiencing a "no-seal" formation include:

a period of substantially invariant fluid pressure that mimics the fluid pressure experienced by the formation pressure tester when carrying out a test that fails to seal.

61. A method according to claim 56 wherein modulations effected by the modulating valve in the case of the pressure tests encountering a tight formation include:

a pressure drop that mimics the fluid pressure experienced by the formation pressure tester when carrying out a pressure test on a tight formation; and a subsequent period without a substantial pressure recovery.

62. A method according to claim 56 including powering the modulating valve, the processor and the logging tool using a source of electrical power at the downhole location.

* * * * *

UNITED STATES PATENT AND TRADEMARK OFFICE

CERTIFICATE OF CORRECTION

PATENT NO. : 7,201,231 B2
APPLICATION NO. : 10/639133
DATED : April 10, 2007
INVENTOR(S) : Chaplin et al.

It is certified that error appears in the above-identified patent and that said Letters Patent is hereby corrected as shown below:

Column 23, Claim 1, replace lines 3 - 5 with the following:
--a positive displacement pump for causing circulation of a fluid under pressure in the wellbore;
a control device for controlling the speed of operation of the pump;-- ;
Column 27, Claim 35, line 5, replace “toot” with --tool--.

Signed and Sealed this

Nineteenth Day of June, 2007

JON W. DUDAS
*Director of the United States Patent and Trademark Office*